US012371991B2

(12) United States Patent
Whitlow et al.

(10) Patent No.: US 12,371,991 B2
(45) Date of Patent: Jul. 29, 2025

(54) SYSTEMS AND METHODS FOR ZEROING FOR DRILLING

(71) Applicant: Helmerich & Payne Technologies, LLC, Tulsa, OK (US)

(72) Inventors: Zackary Whitlow, Denver, CO (US); Ngoc-Ha Dao, Meyzieu (FR)

(73) Assignee: Helmerich & Payne Technologies, LLC, Tulsa, OK (US)

( * ) Notice: Subject to any disclaimer, the term of this patent is extended or adjusted under 35 U.S.C. 154(b) by 0 days.

(21) Appl. No.: 18/168,848

(22) Filed: Feb. 14, 2023

(65) Prior Publication Data

US 2023/0258074 A1 Aug. 17, 2023

Related U.S. Application Data

(60) Provisional application No. 63/267,989, filed on Feb. 14, 2022.

(51) Int. Cl.
*E21B 47/12* (2012.01)
*E21B 44/04* (2006.01)

(52) U.S. Cl.
CPC ..... *E21B 47/12* (2013.01); *E21B 44/04* (2013.01); *E21B 2200/20* (2020.05); *E21B 2200/22* (2020.05)

(58) Field of Classification Search
CPC ..... E21B 47/12; E21B 44/04; E21B 2200/20; E21B 2200/22
See application file for complete search history.

(56) References Cited

U.S. PATENT DOCUMENTS

2015/0275648 A1 10/2015 Wang et al.
2018/0025269 A1* 1/2018 Dursun ..... G06N 3/042 175/24
2021/0340856 A1 11/2021 Forshaw et al.
2022/0082008 A1* 3/2022 Koeneke ..... E21B 23/14
2023/0258074 A1 8/2023 Whitlow et al.

OTHER PUBLICATIONS

Neufeldt, et al., "An Algorithm to Automatically Zero Weight on Bit and Differential Pressure and Resulting Improvements in Data Quality", SPE Drilling and Completion, Available online at: https://doi.org/10.2118/189636-PA, Dec. 17, 2020, pp. 1-18.
PCT/US2023/062544, "International Search Report and Written Opinion", May 12, 2023, 15 pages.

(Continued)

*Primary Examiner* — Dany E Akakpo
(74) *Attorney, Agent, or Firm* — Kilpatrick Townsend & Stockton LLP

(57) ABSTRACT

Embodiments use a torque-and-drag model or fluid friction model for predicting a zero tension or zero pressure for various operations such as rotary drilling and sliding, in vertical, curve, and lateral sections of a well, without using a downhole sensor. By adjusting coefficients of friction, the model can be used to match the predicted hook load, torque, and pressure values with the measured hook load, torque, and pressure values, respectively. A control system can thus determine more accurate zero values for weight on bit and/or differential pressure, which can be used to maintain, alter, plan, modify, and/or predict drilling parameters and conditions.

20 Claims, 19 Drawing Sheets

(56) References Cited

OTHER PUBLICATIONS

Wu, et al., "Calculation of Friction Coefficient and Downhole Weight on Bit With Finite Element Analysis of Drillstring", OnePetro, 46th U.S. Rock Mechanics/Geomechanics Symposium, Jun. 24, 2012.
Cayeux, et al., "Accuracy and Correction of Hook Load Measurements During Drilling Operations", Mar. 2015, 38 pages.
Cayeux, et al., "Challenges and Solutions to the Correct Interpretations of Drilling Friction Tests", Mar. 2017, 39 pages.
Menand, S., "A New Buckling Severity Index to Quantify Failure and Lock-up Risks in Highly Deviated Wells", Jun. 2012, 15 pages.
Zha, et al., "Real Time Surface Data Driven WOB Estimation and Control", Sep. 2018, 17 pages.
PCT/US2023/062544, "International Preliminary Report on Patentability", Aug. 29, 2024, 11 pages.

* cited by examiner $$sWOB(t) = N_{lines}(F_0 - F_{tention}(t))$$

$F_0$ = tension measurement selected as zeroed value $N_{lines}$ = number of lines in drawworks, hookload = N tension

SYSTEMS AND METHODS FOR ZEROING FOR DRILLING

CROSS-REFERENCES TO RELATED APPLICATIONS

This application claims the benefit of U.S. Provisional Patent Application No. 63/267,989, entitled "System and Method for Zeroing for Drilling," filed Feb. 14, 2022, hereby incorporated by reference in its entirety and for all purposes.

BACKGROUND

Field of the Disclosure

The present disclosure relates generally to drilling of wells for oil and gas production and, more particularly, to systems and methods for more accurately zeroing weight on bit (WOB) and/or differential pressure for drilling operations

Description of the Related Art

Drilling a borehole for the extraction of minerals has become an increasingly complicated operation due to the increased depth and complexity of many boreholes, including the complexity added by directional drilling. Drilling is an expensive operation and errors in drilling add to the cost and, in some cases, drilling errors may permanently lower the output of a well for years into the future. Conventional technologies and methods may not adequately address the complicated nature of drilling and may not be capable of gathering and processing various information from downhole sensors and surface control systems in a timely manner, in order to improve drilling operations and minimize drilling errors.

The determination of the well trajectory from a downhole survey may involve various calculations that depend upon reference values and measured values. However, various internal and external factors may adversely affect the downhole survey and, in turn, the determination of the well trajectory.

BRIEF DESCRIPTION OF THE DRAWINGS

For a more complete understanding of the present invention and its features and advantages, reference is now made to the following description, taken in conjunction with the accompanying drawings, in which.

DESCRIPTION OF PARTICULAR EMBODIMENT(S)

Figure 1:
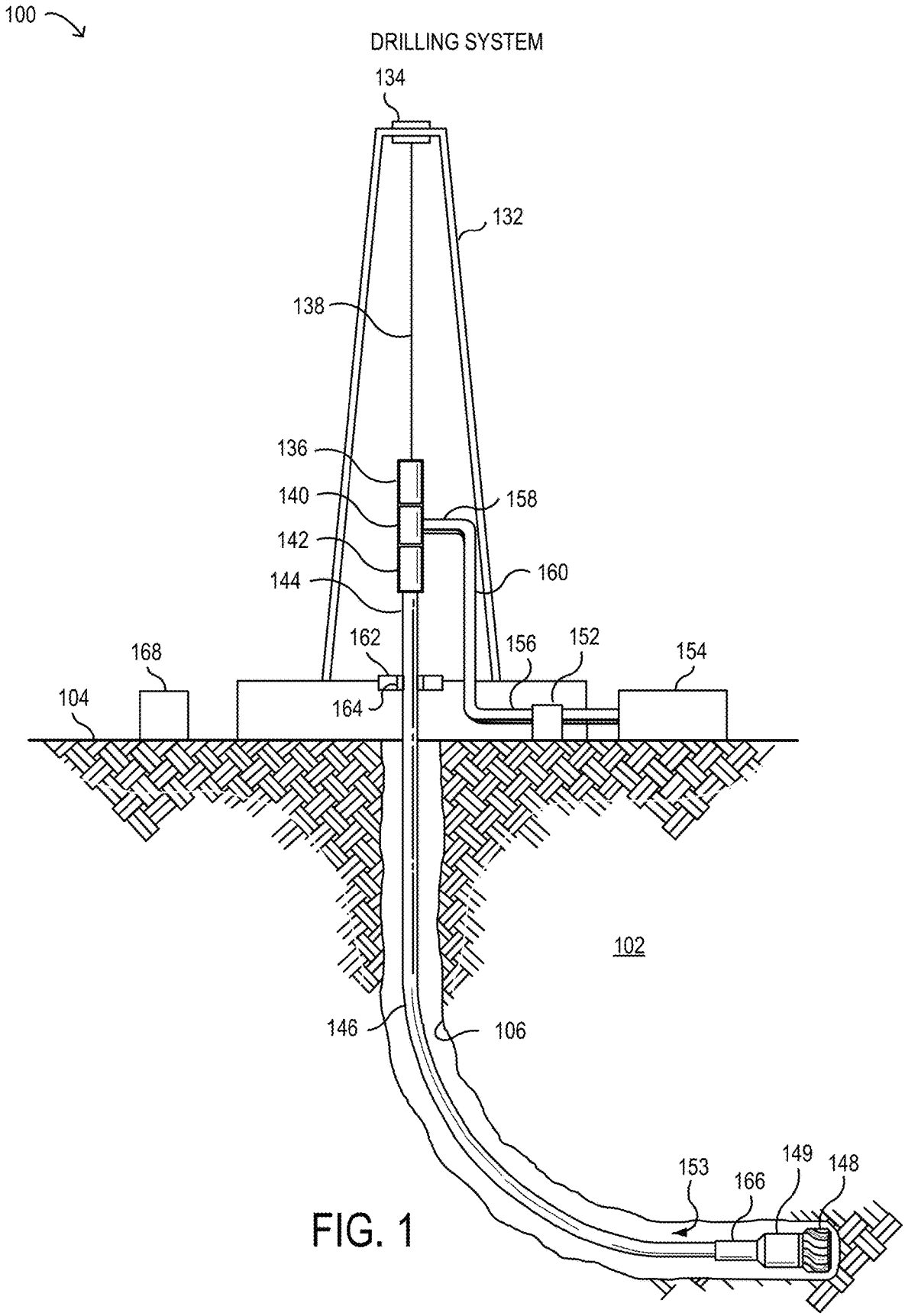
FIG. 1 is a depiction of a drilling system for drilling a borehole.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, as an example (not shown in the drawings), device "12-1" refers to an instance of a device class, which may be referred to collectively as devices "12" and any one of which may be referred to generically as a device "12". In the figures and the description, like numerals are intended to represent like elements.

Drilling a well typically involves a substantial amount of human decision-making during the drilling process. For example, geologists and drilling engineers use their knowledge, experience, and the available information to make decisions on how to plan the drilling operation, how to accomplish the drilling plan, and how to handle issues that arise during drilling. However, even the best geologists and drilling engineers perform some guesswork due to the unique nature of each borehole. Furthermore, a directional human driller performing the drilling may have drilled other boreholes in the same region and so may have some similar experience. However, during drilling operations, a multitude of input information and other factors may affect a drilling decision being made by a human operator or specialist, such that the amount of information may overwhelm the cognitive ability of the human to properly consider and factor into the drilling decision. Furthermore, the quality or the error involved with the drilling decision may improve with larger amounts of input data being considered, for example, such as formation data from a large number of offset wells. For these reasons, human specialists may be unable to achieve optimal drilling decisions, particularly when such drilling decisions are made under time constraints, such as during drilling operations when continuation of drilling is dependent on the drilling decision and, thus, the entire drilling rig waits idly for the next drilling decision. Furthermore, human decision-making for drilling decisions can result in expensive mistakes because drilling errors can add significant cost to drilling operations. In some cases, drilling errors may permanently lower the output of a well, resulting in substantial long term economic losses due to the lost output of the well.

Referring now to the drawings, Referring to FIG. 1, a drilling system 100 is illustrated in one embodiment as a top drive system. As shown, the drilling system 100 includes a derrick 132 on the surface 104 of the earth and is used to drill a borehole 106 into the earth. Typically, drilling system 100 is used at a location corresponding to a geographic formation 102 in the earth that is known.

In FIG. 1, derrick 132 includes a crown block 134 to which a traveling block 136 is coupled via a drilling line 138. In drilling system 100, a top drive 140 is coupled to traveling block 136 and may provide rotational force for drilling. A saver sub 142 may sit between the top drive 140 and a drill pipe 144 that is part of a drill string 146. Top drive 140 may rotate drill string 146 via the saver sub 142, which in turn may rotate a drill bit 148 of a bottom hole assembly (BHA) 149 in borehole 106 passing through formation 102. Also visible in drilling system 100 is a rotary table 162 that may be fitted with a master bushing 164 to hold drill string 146 when not rotating.

A mud pump 152 may direct a fluid mixture 153 (e.g., a mud mixture) from a mud pit 154 into drill string 146. Mud pit 154 is shown schematically as a container, but it is noted that various receptacles, tanks, pits, or other containers may be used. Mud 153 may flow from mud pump 152 into a discharge line 156 that is coupled to a rotary hose 158 by a standpipe 160. Rotary hose 158 may then be coupled to top drive 140, which includes a passage for mud 153 to flow into borehole 106 via drill string 146 from where mud 153 may emerge at drill bit 148. Mud 153 may lubricate drill bit 148 during drilling and, due to the pressure supplied by mud pump 152, mud 153 may return via borehole 106 to surface 104.

In drilling system 100, drilling equipment (see also FIG. 5) is used to perform the drilling of borehole 106, such as top drive 140 (or rotary drive equipment) that couples to drill string 146 and BHA 149 and is configured to rotate drill string 146 and apply pressure to drill bit 148. Drilling system 100 may include control systems such as a WOB/differential pressure control system 522, a positional/rotary control system 524, a fluid circulation control system 526, and a sensor system 528, as further described below with respect to FIG. 5. The control systems may be used to monitor and change drilling rig settings, such as the WOB or differential pressure to alter the ROP or the radial orientation of the toolface, change the flow rate of drilling mud, and perform other operations. Sensor system 528 may be for obtaining sensor data about the drilling operation and drilling system 100, including the downhole equipment. For example, sensor system 528 may include MWD or logging while drilling (LWD) tools for acquiring information, such as toolface and formation logging information, that may be saved for later retrieval, transmitted with or without a delay using any of various communication means (e.g., wireless, wireline, or mud pulse telemetry), or otherwise transferred to steering control system 168. As used herein, an MWD tool is enabled to communicate downhole measurements without substantial delay to the surface 104, such as using mud pulse telemetry, while a LWD tool is equipped with an internal memory that stores measurements when downhole and can be used to download a stored log of measurements when the LWD tool is at the surface 104. The internal memory in the LWD tool may be a removable memory, such as a universal serial bus (USB) memory device or another removable memory device. It is noted that certain downhole tools may have both MWD and LWD capabilities. Such information acquired by sensor system 528 may include information related to hole depth, bit depth, inclination angle, azimuth angle, true vertical depth, gamma count, standpipe pressure, mud flow rate, rotary rotations per minute (RPM), bit speed, ROP, WOB, among other information. It is noted that all or part of sensor system 528 may be incorporated into a control system, or in another component of the drilling equipment. As drilling system 100 can be configured in many different implementations, it is noted that different control systems and subsystems may be used.

Sensing, detection, measurement, evaluation, storage, alarm, and other functionality may be incorporated into a downhole tool 166 or BHA 149 or elsewhere along drill string 146 to provide downhole surveys of borehole 106. Accordingly, downhole tool 166 may be an MWD tool or a LWD tool or both, and may accordingly utilize connectivity to the surface 104, local storage, or both. In different implementations, gamma radiation sensors, magnetometers, accelerometers, and other types of sensors may be used for the downhole surveys. Although downhole tool 166 is shown in singular in drilling system 100, it is noted that multiple instances (not shown) of downhole tool 166 may be located at one or more locations along drill string 146.

In some embodiments, formation detection and evaluation functionality may be provided via a steering control system 168 on the surface 104. Steering control system 168 may be located in proximity to derrick 132 or may be included with drilling system 100. In other embodiments, steering control system 168 may be remote from the actual location of borehole 106 (see also FIG. 4). For example, steering control system 168 may be a stand-alone system or may be incorporated into other systems included with drilling system 100.

In operation, steering control system 168 may be accessible via a communication network (see also FIG. 10) and may accordingly receive formation information via the communication network. In some embodiments, steering control system 168 may use the evaluation functionality to provide corrective measures, such as a convergence plan to overcome an error in the well trajectory of borehole 106 with respect to a reference, or a planned well trajectory. The convergence plans or other corrective measures may depend on a determination of the well trajectory, and therefore, may be improved in accuracy using surface steering, as disclosed herein.

In particular embodiments, at least a portion of steering control system 168 may be located in downhole tool 166 (not shown). In some embodiments, steering control system 168 may communicate with a separate controller (not shown) located in downhole tool 166. In particular, steering control system 168 may receive and process measurements received from downhole surveys and may perform the calculations described herein for surface steering using the downhole surveys and other information referenced herein.

In drilling system 100, to aid in the drilling process, data is collected from borehole 106, such as from sensors in BHA 149, downhole tool 166, or both. The collected data may include the geological characteristics of formation 102 in which borehole 106 was formed, the attributes of drilling system 100, including BHA 149, and drilling information such as weight-on-bit (WOB), drilling speed, and other information pertinent to the formation of borehole 106. The drilling information may be associated with a particular depth or another identifiable marker to index collected data. For example, the collected data for borehole 106 may capture drilling information indicating that drilling of the well from 1,000 feet to 1,200 feet occurred at a first rate of penetration (ROP) through a first rock layer with a first WOB, while drilling from 1,200 feet to 1,500 feet occurred at a second ROP through a second rock layer with a second WOB (see also FIG. 2). In some applications, the collected data may be used to virtually recreate the drilling process that created borehole 106 in formation 102, such as by displaying a computer simulation of the drilling process. The accuracy with which the drilling process can be recreated depends on a level of detail and accuracy of the collected data, including collected data from a downhole survey of the well trajectory.

The collected data may be stored in a database that is accessible via a communication network for example. In some embodiments, the database storing the collected data for borehole 106 may be located locally at drilling system 100, at a drilling hub that supports a plurality of drilling systems 100 in a region, or at a database server accessible over the communication network that provides access to the database (see also FIG. 4). At drilling system 100, the collected data may be stored at the surface 104 or downhole in drill string 146, such as in a memory device included with BHA 149 (see also FIG. 10). Alternatively, at least a portion of the collected data may be stored on a removable storage medium, such as using steering control system 168 or BHA 149, that is later coupled to the database in order to transfer the collected data to the database, which may be manually performed at certain intervals, for example.

In FIG. 1, steering control system 168 is located at or near the surface 104 where borehole 106 is being drilled. Steering control system 168 may be coupled to equipment used in drilling system 100 and may also be coupled to the database, whether the database is physically located locally, regionally, or centrally (see also FIGS. 4 and 5). Accordingly, steering control system 168 may collect and record various inputs, such as measurement data from a magnetometer and an accelerometer that may also be included with BHA 149.

Steering control system 168 may further be used as a surface steerable system, along with the database, as described above. The surface steerable system may enable an operator to plan and control drilling operations while drilling is being performed. The surface steerable system may itself also be used to perform certain drilling operations, such as controlling certain control systems that, in turn, control the actual equipment in drilling system 100 (see also FIG. 5). The control of drilling equipment and drilling operations by steering control system 168 may be manual, manual-assisted, semi-automatic, or automatic, in different embodiments.

Manual control may involve direct control of the drilling rig equipment, albeit with certain safety limits to prevent unsafe or undesired actions or collisions of different equipment. To enable manual-assisted control, steering control system 168 may present various information, such as using a graphical user interface (GUI) displayed on a display device (see FIG. 8), to a human operator, and may provide controls that enable the human operator to perform a control operation. The information presented to the user may include live measurements and feedback from the drilling rig and steering control system 168, or the drilling rig itself, and may further include limits and safety-related elements to prevent unwanted actions or equipment states, in response to a manual control command entered by the user using the GUI.

To implement semi-automatic control, steering control system 168 may itself propose or indicate to the user, such as via the GUI, that a certain control operation, or a sequence of control operations, should be performed at a given time. Then, steering control system 168 may enable the user to imitate the indicated control operation or sequence of control operations, such that once manually started, the indicated control operation or sequence of control operations is automatically completed. The limits and safety features mentioned above for manual control would still apply for semi-automatic control. It is noted that steering control system 168 may execute semi-automatic control using a secondary processor, such as an embedded controller that executes under a real-time operating system (RTOS), that is under the control and command of steering control system 168. To implement automatic control, the step of manual starting the indicated control operation or sequence of operations is eliminated, and steering control system 168 may proceed with only a passive notification to the user of the actions taken.

In order to implement various control operations, steering control system 168 may perform (or may cause to be performed) various input operations, processing operations, and output operations. The input operations performed by steering control system 168 may result in measurements or other input information being made available for use in any subsequent operations, such as processing or output operations. The input operations may accordingly provide the input information, including feedback from the drilling process itself, to steering control system 168. The processing operations performed by steering control system 168 may be any processing operation associated with surface steering, as disclosed herein. The output operations performed by steering control system 168 may involve generating output information for use by external entities, or for output to a user, such as in the form of updated elements in the GUI, for example. The output information may include at least some of the input information, enabling steering control system 168 to distribute information among various entities and processors.

In particular, the operations performed by steering control system 168 may include operations such as receiving drilling data representing a drill path, receiving other drilling parameters, calculating a drilling solution for the drill path based on the received data and other available data (e.g., rig characteristics), implementing the drilling solution at the drilling rig, monitoring the drilling process to gauge whether the drilling process is within a defined margin of error of the drill path, and calculating corrections for the drilling process if the drilling process is outside of the margin of error.

Accordingly, steering control system 168 may receive input information either before drilling, during drilling, or after drilling of borehole 106. The input information may comprise measurements from one or more sensors, as well as survey information collected while drilling borehole 106. The input information may also include a well plan, a regional formation history, drilling engineer parameters, downhole tool face/inclination information, downhole tool gamma/resistivity information, economic parameters, reliability parameters, among various other parameters. Some of the input information, such as the regional formation history, may be available from a drilling hub 410, which may have respective access to a regional drilling database (DB) 412 (see FIG. 4). Other input information may be accessed or uploaded from other sources to steering control system 168. For example, a web interface may be used to interact directly with steering control system 168 to upload the well plan or drilling parameters.

As noted, the input information may be provided to steering control system 168. After processing by steering control system 168, steering control system 168 may generate control information that may be output to drilling rig 210 (e.g., to rig controls 520 that control drilling equipment 530, see also FIGS. 2 and 5). Drilling rig 210 may provide feedback information using rig controls 520 to steering control system 168. The feedback information may then serve as input information to steering control system 168, thereby enabling steering control system 168 to perform feedback loop control and validation. Accordingly, steering control system 168 may be configured to modify its output information to the drilling rig, in order to achieve the desired results, which are indicated in the feedback information. The output information generated by steering control system 168 may include indications to modify one or more drilling parameters, the direction of drilling, the drilling mode, among others. In certain operational modes, such as semi-automatic or automatic, steering control system 168 may generate output information indicative of instructions to rig controls 520 to enable automatic drilling using the latest location of BHA 149. Therefore, an improved accuracy in the determination of the location of BHA 149 may be provided using steering control system 168, along with the methods and operations for surface steering disclosed herein.

Figure 2:
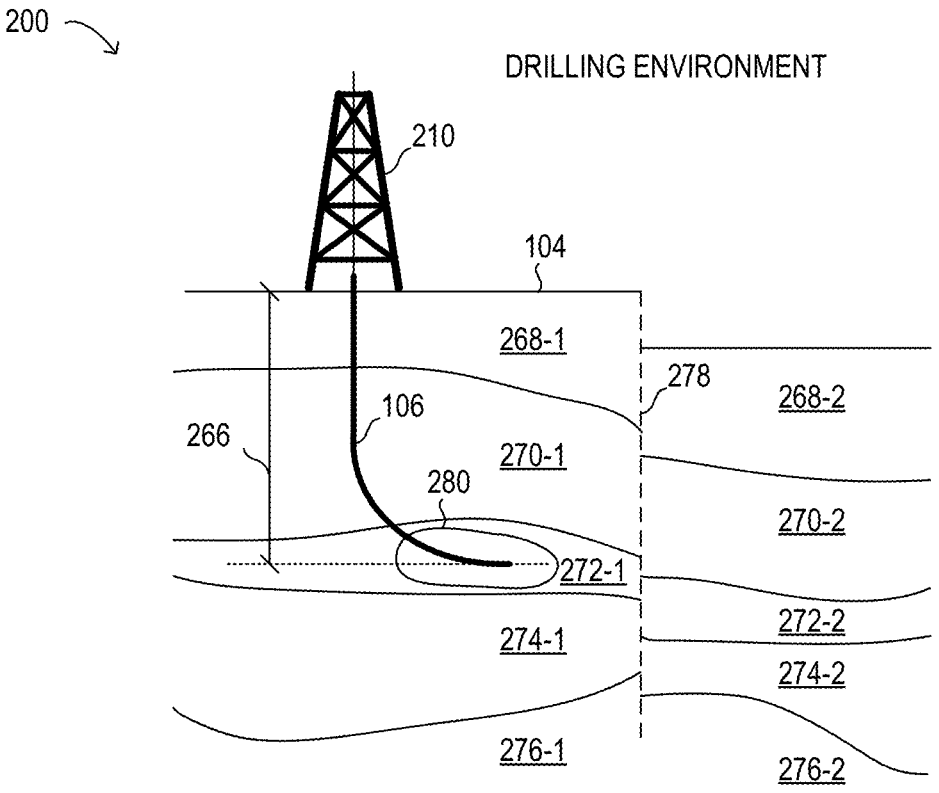
FIG. 2 is a depiction of a drilling environment including the drilling system for drilling a borehole.

Referring now to FIG. 2, a drilling environment 200 is depicted schematically and is not drawn to scale or perspective. In particular, drilling environment 200 may illustrate additional details with respect to formation 102 below the surface 104 in drilling system 100 shown in FIG. 1. In FIG. 2, drilling rig 210 may represent various equipment discussed above with respect to drilling system 100 in FIG. 1 that is located at the surface 104.

In drilling environment 200, it may be assumed that a drilling plan (also referred to as a well plan) has been formulated to drill borehole 106 extending into the ground to a true vertical depth (TVD) 266 and penetrating several subterranean strata layers. Borehole 106 is shown in FIG. 2 extending through strata layers 268-1 and 270-1, while terminating in strata layer 272-1. Accordingly, as shown, borehole 106 does not extend or reach underlying strata layers 274-1 and 276-1. A target area 280 specified in the drilling plan may be located in strata layer 272-1 as shown in FIG. 2. Target area 280 may represent a desired endpoint of borehole 106, such as a hydrocarbon producing area indicated by strata layer 272-1. It is noted that target area 280 may be of any shape and size and may be defined using various different methods and information in different embodiments. In some instances, target area 280 may be specified in the drilling plan using subsurface coordinates, or references to certain markers, which indicate where borehole 106 is to be terminated. In other instances, target area may be specified in the drilling plan using a depth range within which borehole 106 is to remain. For example, the depth range may correspond to strata layer 272-1. In other examples, target area 280 may extend as far as can be realistically drilled. For example, when borehole 106 is specified to have a horizontal section with a goal to extend into strata layer 272 as far as possible, target area 280 may be defined as strata layer 272-1 itself and drilling may continue until some other physical limit is reached, such as a property boundary or a physical limitation to the length of the drill string.

Also visible in FIG. 2 is a fault line 278 that has resulted in a subterranean discontinuity in the fault structure. Specifically, strata layers 268, 270, 272, 274, and 276 have portions on either side of fault line 278. On one side of fault line 278, where borehole 106 is located, strata layers 268-1, 270-1, 272-1, 274-1, and 276-1 are unshifted by fault line 278. On the other side of fault line 278, strata layers 268-2, 270-2, 272-2, 274-2, and 276-2 are shifted downwards by fault line 278.

Current drilling operations frequently include directional drilling to reach a target, such as target area 280. The use of directional drilling has been found to generally increase an overall amount of production volume per well, but also may lead to significantly higher production rates per well, which are both economically desirable. As shown in FIG. 2, directional drilling may be used to drill the horizontal portion of borehole 106, which increases an exposed length of borehole 106 within strata layer 272-1, and which may accordingly be beneficial for hydrocarbon extraction from strata layer 272-1. Directional drilling may also be used alter an angle of borehole 106 to accommodate subterranean faults, such as indicated by fault line 278 in FIG. 2. Other benefits that may be achieved using directional drilling include sidetracking off of an existing well to reach a different target area or a missed target area, drilling around abandoned drilling equipment, drilling into otherwise inaccessible or difficult to reach locations (e.g., under populated areas or bodies of water), providing a relief well for an existing well, and increasing the capacity of a well by branching off and having multiple boreholes extending in different directions or at different vertical positions for the same well. Directional drilling is often not limited to a straight horizontal borehole 106 but may involve staying within a strata layer that varies in depth and thickness as illustrated by strata layer 172. As such, directional drilling may involve multiple vertical adjustments that complicate the trajectory of borehole 106.

Figure 3:
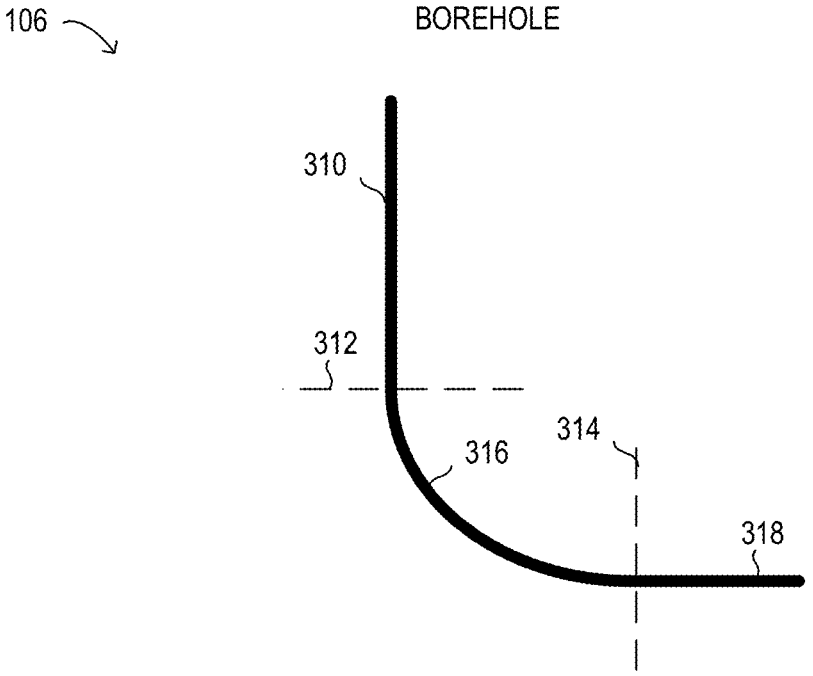
FIG. 3 is a depiction of a borehole generated in the drilling environment.

Referring now to FIG. 3, one embodiment of a portion of borehole 106 is shown in further detail. Using directional drilling for horizontal drilling may introduce certain challenges or difficulties that may not be observed during vertical drilling of borehole 106. For example, a horizontal portion 318 of borehole 106 may be started from a vertical portion 310. In order to make the transition from vertical to horizontal, a curve may be defined that specifies a so-called "build up" section 316. Build up section 316 may begin at a kickoff point 312 in vertical portion 310 and may end at a begin point 314 of horizontal portion 318. The change in inclination in buildup section 316 per measured length drilled is referred to herein as a "build rate" and may be defined in degrees per one hundred feet drilled. For example, the build rate may have a value of 6°/100 ft., indicating that there is a six degree change in inclination for every one hundred feet drilled. The build rate for a particular build up section may remain relatively constant or may vary.

The build rate used for any given build up section may depend on various factors, such as properties of the formation (i.e., strata layers) through which borehole 106 is to be drilled, the trajectory of borehole 106, the particular pipe and drill collars/BHA components used (e.g., length, diameter, flexibility, strength, mud motor bend setting, and drill bit), the mud type and flow rate, the specified horizontal displacement, stabilization, and inclination, among other factors. An overly aggressive built rate can cause problems such as severe doglegs (e.g., sharp changes in direction in the borehole) that may make it difficult or impossible to run casing or perform other operations in borehole 106. Depending on the severity of any mistakes made during directional drilling, borehole 106 may be enlarged or drill bit 146 may be backed out of a portion of borehole 106 and redrilled along a different path. Such mistakes may be undesirable due to the additional time and expense involved. However, if the built rate is too cautious, additional overall time may be added to the drilling process because directional drilling generally involves a lower ROP than straight drilling. Furthermore, directional drilling for a curve is more complicated than vertical drilling and the possibility of drilling errors increases with directional drilling (e.g., overshoot and undershoot that may occur while trying to keep drill bit 148 on the planned trajectory).

Two modes of drilling, referred to herein as "rotating" and "sliding," are commonly used to form borehole 106. Rotating, also called "rotary drilling," uses top drive 140 or rotary table 162 to rotate drill string 146. Rotating may be used when drilling occurs along a straight trajectory, such as for vertical portion 310 of borehole 106. Sliding, also called "steering" or "directional drilling" as noted above, typically uses a mud motor located downhole at BHA 149. The mud motor may have an adjustable bent housing and is not powered by rotation of the drill string. Instead, the mud motor uses hydraulic power derived from the pressurized drilling mud that circulates along borehole 106 to and from the surface 104 to directionally drill borehole 106 in build-up section 316.

Thus, sliding is used in order to control the direction of the well trajectory during directional drilling. A method to perform a slide may include the following operations. First, during vertical or straight drilling, the rotation of drill string 146 is stopped. Based on feedback from measuring equipment, such as from downhole tool 166, adjustments may be made to drill string 146, such as using top drive 140 to apply various combinations of torque, WOB, and vibration, among other adjustments. The adjustments may continue until a tool face is confirmed that indicates a direction of the bend of the mud motor is oriented to a direction of a desired deviation (i.e., build rate) of borehole 106. Once the desired orientation of the mud motor is attained, WOB to the drill bit is increased, which causes the drill bit to move in the desired direction of deviation. Once sufficient distance and angle have been built up in the curved trajectory, a transition back to rotating mode can be accomplished by rotating the drill string again. The rotation of the drill string after sliding may neutralize the directional deviation caused by the bend in the mud motor due to the continuous rotation around a centerline of borehole 106.

Figure 4:
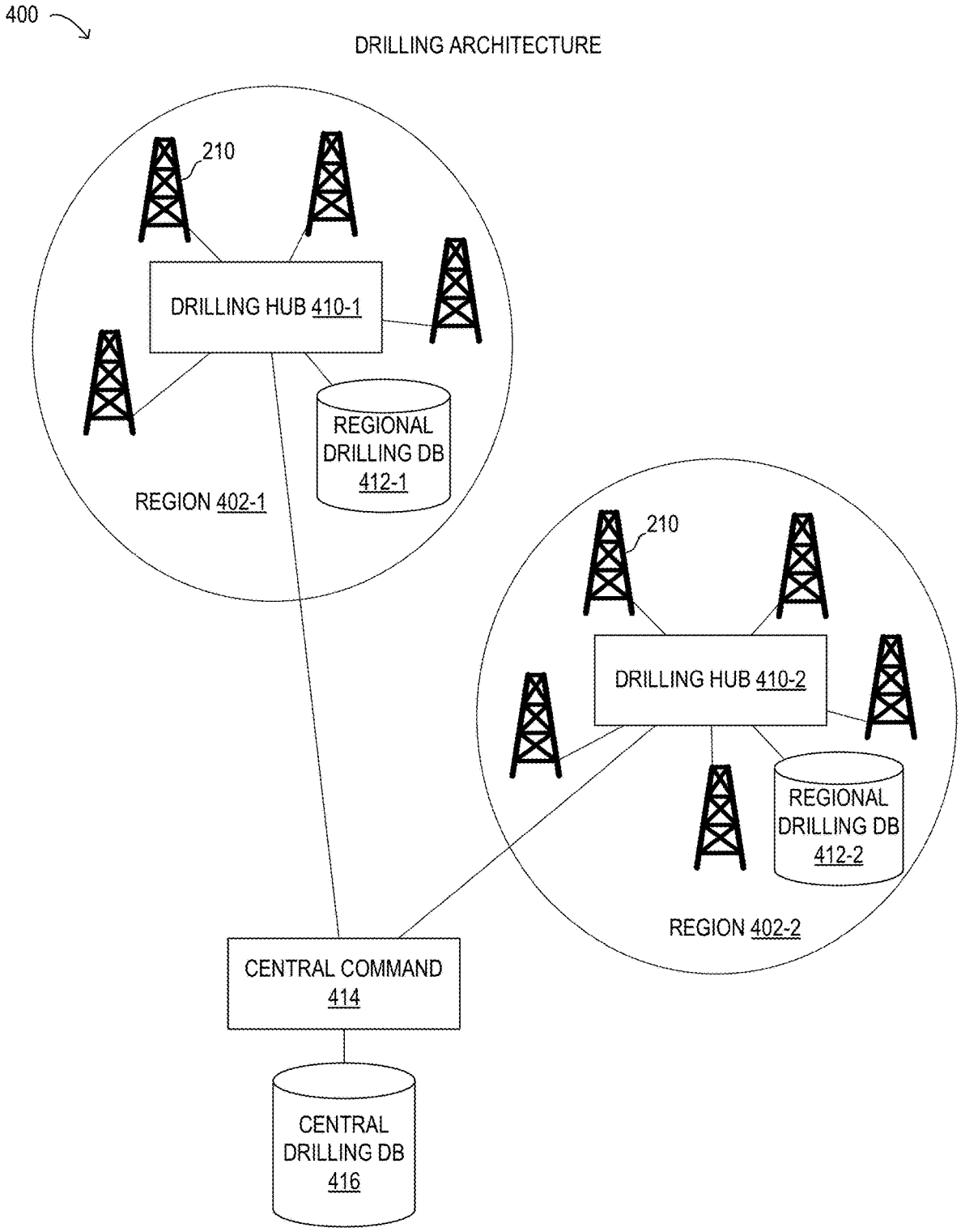
FIG. 4 is a depiction of a drilling architecture including the drilling environment.

Referring now to FIG. 4, a drilling architecture 400 is illustrated in diagram form. As shown, drilling architecture 400 depicts a hierarchical arrangement of drilling hubs 410 and a central command 414, to support the operation of a plurality of drilling rigs 210 in different regions 402. Specifically, as described above with respect to FIGS. 1 and 2, drilling rig 210 includes steering control system 168 that is enabled to perform various drilling control operations locally to drilling rig 210. When steering control system 168 is enabled with network connectivity, certain control operations or processing may be requested or queried by steering control system 168 from a remote processing resource. As shown in FIG. 4, drilling hubs 410 represent a remote processing resource for steering control system 168 located at respective regions 402, while central command 414 may represent a remote processing resource for both drilling hub 410 and steering control system 168.

Specifically, in a region 402-1, a drilling hub 410-1 may serve as a remote processing resource for drilling rigs 210 located in region 402-1, which may vary in number and are not limited to the exemplary schematic illustration of FIG. 4. Additionally, drilling hub 410-1 may have access to a regional drilling DB 412-1, which may be local to drilling hub 410-1. Additionally, in a region 402-2, a drilling hub 410-2 may serve as a remote processing resource for drilling rigs 210 located in region 402-2, which may vary in number and are not limited to the exemplary schematic illustration of FIG. 4. Additionally, drilling hub 410-2 may have access to a regional drilling DB 412-2, which may be local to drilling hub 410-2.

In FIG. 4, respective regions 402 may exhibit the same or similar geological formations. Thus, reference wells, or offset wells, may exist in a vicinity of a given drilling rig 210 in region 402, or where a new well is planned in region 402. Furthermore, multiple drilling rigs 210 may be actively drilling concurrently in region 402 and may be in different stages of drilling through the depths of formation strata layers at region 402. Thus, for any given well being drilled by drilling rig 210 in a region 402, survey data from the reference wells or offset wells may be used to create the well plan, and may be used for surface steering, as disclosed herein. In some implementations, survey data or reference data from a plurality of reference wells may be used to improve drilling performance, such as by reducing an error in estimating TVD or a position of BHA 149 relative to one or more strata layers, as will be described in further detail herein. Additionally, survey data from recently drilled wells, or wells still currently being drilled, including the same well, may be used for reducing an error in estimating TVD or a position of BHA 149 relative to one or more strata layers.

Also shown in FIG. 4 is central command 414, which has access to central drilling DB 416, and may be located at a centralized command center that is in communication with drilling hubs 410 and drilling rigs 210 in various regions 402. The centralized command center may have the ability to monitor drilling and equipment activity at any one or more drilling rigs 210. In some embodiments, central command 414 and drilling hubs 412 may be operated by a commercial operator of drilling rigs 210 as a service to customers who have hired the commercial operator to drill wells and provide other drilling-related services.

In FIG. 4, it is particularly noted that central drilling DB 416 may be a central repository that is accessible to drilling hubs 410 and drilling rigs 210. Accordingly, central drilling DB 416 may store information for various drilling rigs 210 in different regions 402. In some embodiments, central drilling DB 416 may serve as a backup for at least one regional drilling DB 412 or may otherwise redundantly store information that is also stored on at least one regional drilling DB 412. In turn, regional drilling DB 412 may serve as a backup or redundant storage for at least one drilling rig 210 in region 402. For example, regional drilling DB 412 may store information collected by steering control system 168 from drilling rig 210.

In some embodiments, the formulation of a drilling plan for drilling rig 210 may include processing and analyzing the collected data in regional drilling DB 412 to create a more effective drilling plan. Furthermore, once the drilling has begun, the collected data may be used in conjunction with current data from drilling rig 210 to improve drilling decisions. As noted, the functionality of steering control system 168 may be provided at drilling rig 210, or may be provided, at least in part, at a remote processing resource, such as drilling hub 410 or central command 414.

As noted, steering control system 168 may provide functionality as a surface steerable system for controlling drilling rig 210. Steering control system 168 may have access to regional drilling DB 412 and central drilling DB 416 to provide the surface steerable system functionality. As will be described in greater detail below, steering control system 168 may be used to plan and control drilling operations based on input information, including feedback from the drilling process itself. Steering control system 168 may be used to perform operations such as receiving drilling data representing a drill trajectory and other drilling parameters, calculating a drilling solution for the drill trajectory based on the received data and other available data (e.g., rig characteristics), implementing the drilling solution at drilling rig 210, monitoring the drilling process to gauge whether the drilling process is within a margin of error that is defined for the drill trajectory, or calculating corrections for the drilling process if the drilling process is outside of the margin of error.

Figure 5:
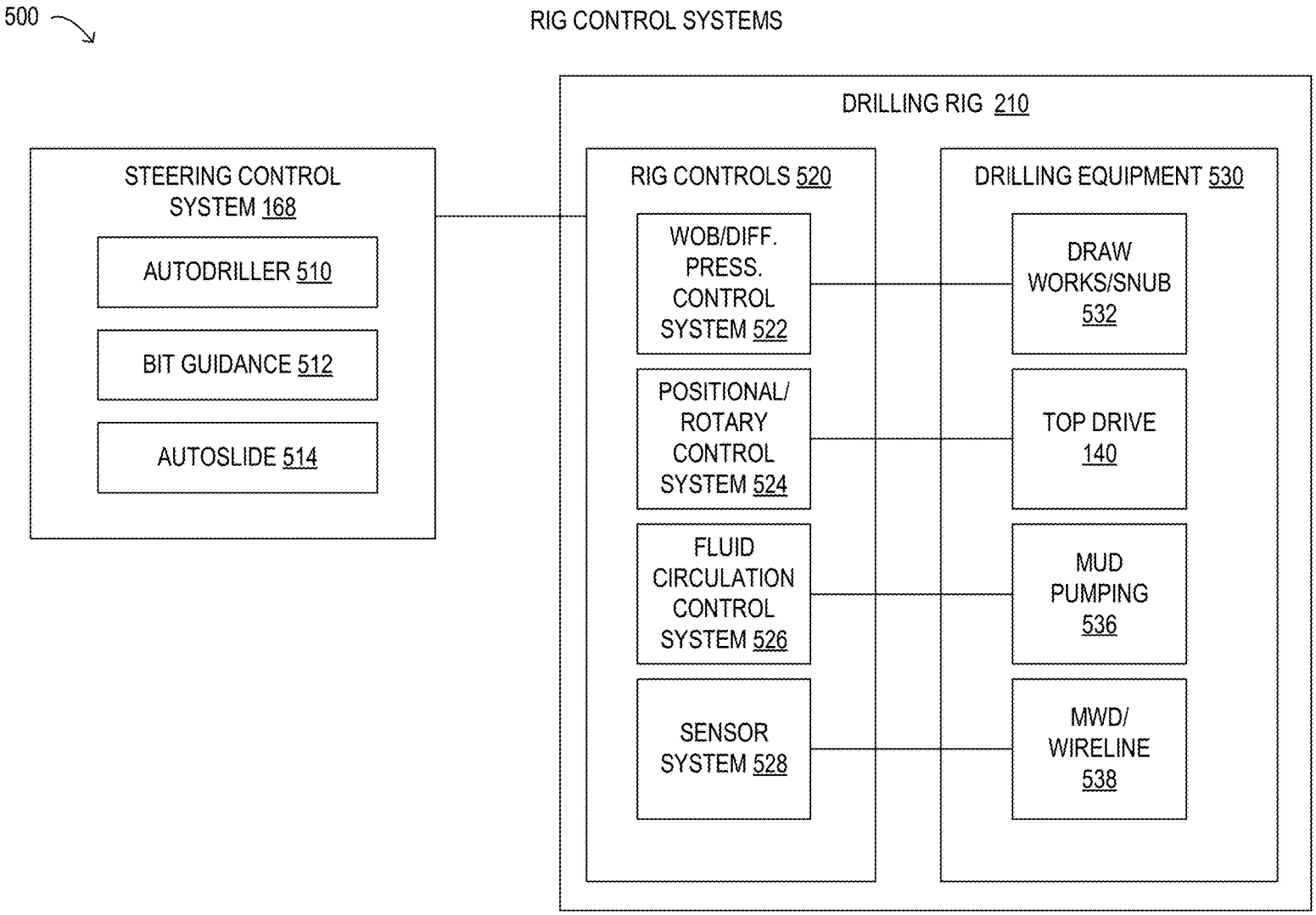
FIG. 5 is a depiction of rig control systems included in the drilling system.

Referring now to FIG. 5, an example of rig control systems 500 is illustrated in schematic form. It is noted that rig control systems 500 may include fewer or more elements than shown in FIG. 5 in different embodiments. As shown, rig control systems 500 includes steering control system 168 and drilling rig 210. Specifically, steering control system 168 is shown with logical functionality including an autodriller 510, a bit guidance 512, and an autoslide 514. Drilling rig 210 is hierarchically shown including rig controls 520, which provide secure control logic and processing capability, along with drilling equipment 530, which represents the physical equipment used for drilling at drilling rig 210. As shown, rig controls 520 include WOB/differential pressure control system 522, positional/rotary control system 524, fluid circulation control system 526, and sensor system 528, while drilling equipment 530 includes a draw works/snub 532, top drive 140, a mud pumping 536, and an MWD/wireline 538.

Figure 10:
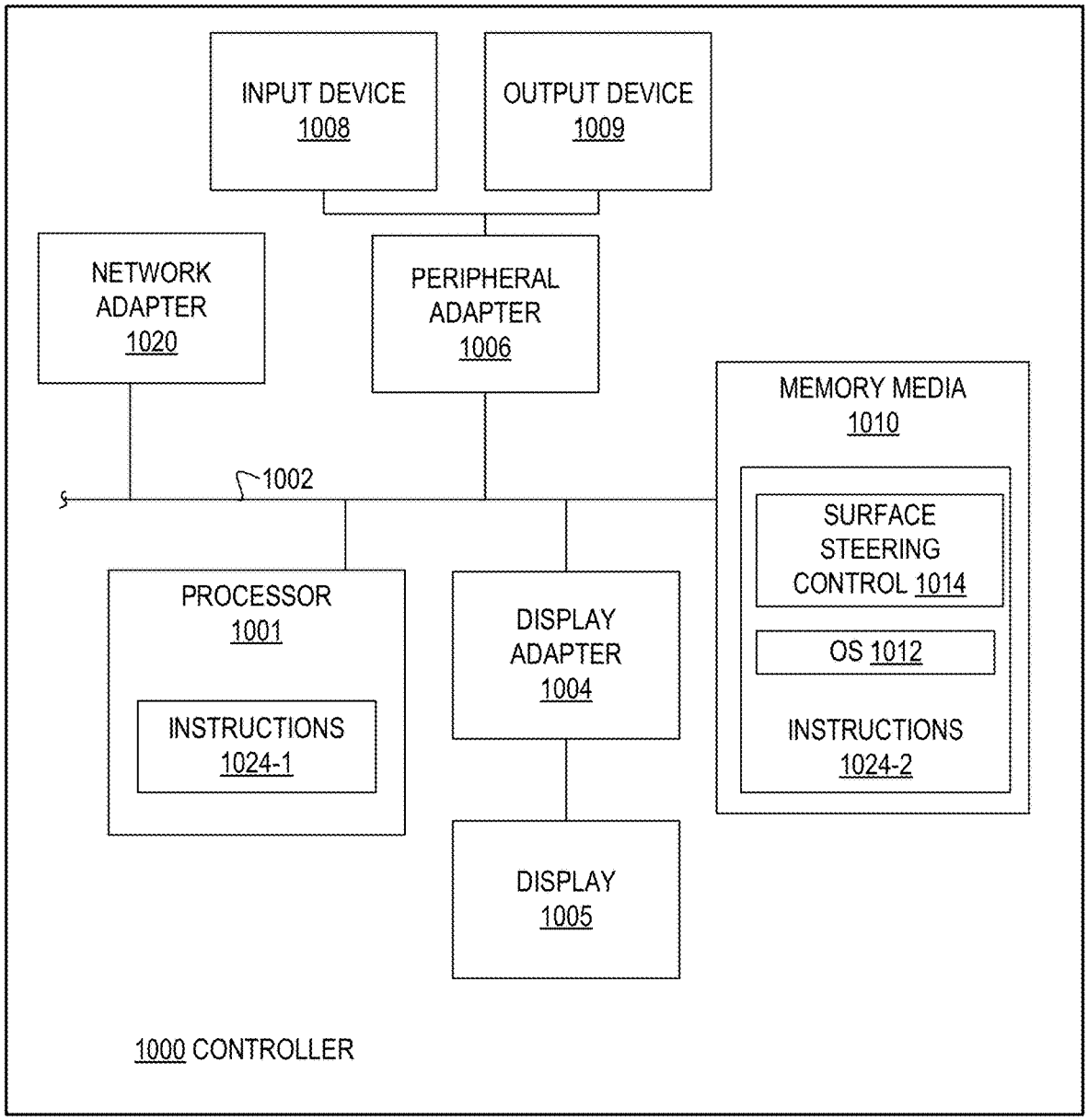
FIG. 10 is a depiction of a controller usable by the rig control systems.

Steering control system 168 represent an instance of a processor having an accessible memory storing instructions executable by the processor, such as an instance of controller 1000 shown in FIG. 10. Also, WOB/differential pressure control system 522, positional/rotary control system 524, and fluid circulation control system 526 may each represent an instance of a processor having an accessible memory storing instructions executable by the processor, such as an instance of controller 1000 shown in FIG. 10, but for example, in a configuration as a programmable logic controller (PLC) that may not include a user interface but may be used as an embedded controller. Accordingly, it is noted that each of the systems included in rig controls 520 may be a separate controller, such as a PLC, and may autonomously operate, at least to a degree. Steering control system 168 may represent hardware that executes instructions to implement a surface steerable system that provides feedback and automation capability to an operator, such as a driller. For example, steering control system 168 may cause autodriller 510, bit guidance 512 (also referred to as a bit guidance system (BGS)), and autoslide 514 (among others, not shown) to be activated and executed at an appropriate time during drilling. In particular implementations, steering control system 168 may be enabled to provide a user interface during drilling, such as the user interface 850 depicted and described below with respect to FIG. 8. Accordingly, steering control system 168 may interface with rig controls 520 to facilitate manual, assisted manual, semi-automatic, and automatic operation of drilling equipment 530 included in drilling rig 210. It is noted that rig controls 520 may also accordingly be enabled for manual or user-controlled operation of drilling and may include certain levels of automation with respect to drilling equipment 530.

In rig control systems 500 of FIG. 5, WOB/differential pressure control system 522 may be interfaced with draw works/snubbing unit 532 to control WOB of drill string 146. Positional/rotary control system 524 may be interfaced with top drive 140 to control rotation of drill string 146. Fluid circulation control system 526 may be interfaced with mud pumping 536 to control mud flow and may also receive and decode mud telemetry signals. Sensor system 528 may be interfaced with MWD/wireline 538, which may represent various BHA sensors and instrumentation equipment, among other sensors that may be downhole or at the surface.

In rig control systems 500, autodriller 510 may represent an automated rotary drilling system and may be used for controlling rotary drilling. Accordingly, autodriller 510 may enable automate operation of rig controls 520 during rotary drilling, as indicated in the well plan. Bit guidance 512 may represent an automated control system to monitor and control performance and operation drilling bit 148.

In rig control systems 500, autoslide 514 may represent an automated slide drilling system and may be used for controlling slide drilling. Accordingly, autoslide 514 may enable automate operation of rig controls 520 during a slide and may return control to steering control system 168 for rotary drilling at an appropriate time, as indicated in the well plan. In particular implementations, autoslide 514 may be enabled to provide a user interface during slide drilling to specifically monitor and control the slide. For example, autoslide 514 may rely on bit guidance 512 for orienting a tool face and on autodriller 510 to set WOB or control rotation or vibration of drill string 146.

Figure 6:
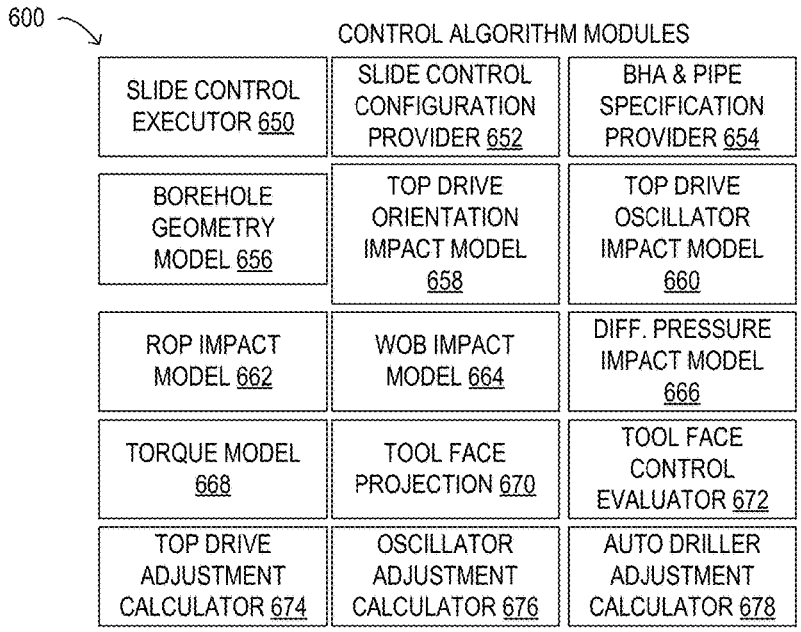
FIG. 6 is a depiction of algorithm modules used by the rig control systems.

FIG. 6 illustrates one embodiment of control algorithm modules 600 used with steering control system 168. The control algorithm modules 600 of FIG. 6 include: a slide control executor 650 that is responsible for managing the execution of the slide control algorithms; a slide control configuration provider 652 that is responsible for validating, maintaining, and providing configuration parameters for the other software modules; a BHA & pipe specification provider 654 that is responsible for managing and providing details of BHA 149 and drill string 146 characteristics; a borehole geometry model 656 that is responsible for keeping track of the borehole geometry and providing a representation to other software modules; a top drive orientation impact model 658 that is responsible for modeling the impact that changes to the angular orientation of top drive 140 have had on the tool face control; a top drive oscillator impact model 660 that is responsible for modeling the impact that oscillations of top drive 140 has had on the tool face control; an ROP impact model 662 that is responsible for modeling the effect on the tool face control of a change in ROP or a corresponding ROP set point; a WOB impact model 664 that is responsible for modeling the effect on the tool face control of a change in WOB or a corresponding WOB set point; a differential pressure impact model 666 that is responsible for modeling the effect on the tool face control of a change in differential pressure (DP) or a corresponding DP set point; a torque model 668 that is responsible for modeling the comprehensive representation of torque for surface, downhole, break over, and reactive torque, modeling impact of those torque values on tool face control, and determining torque operational thresholds; a tool face control evaluator 672 that is responsible for evaluating all factors impacting tool face control and whether adjustments need to be projected, determining whether re-alignment off-bottom is indicated, and determining off-bottom tool face operational threshold windows; a tool face projection 670 that is responsible for projecting tool face behavior for top drive 140, the top drive oscillator, and auto driller adjustments; a top drive adjustment calculator 674 that is responsible for calculating top drive adjustments resultant to tool face projections; an oscillator adjustment calculator 676 that is responsible for calculating oscillator adjustments resultant to tool face projections; and an autodriller adjustment calculator 678 that is responsible for calculating adjustments to autodriller 510 resultant to tool face projections.

Figure 7:
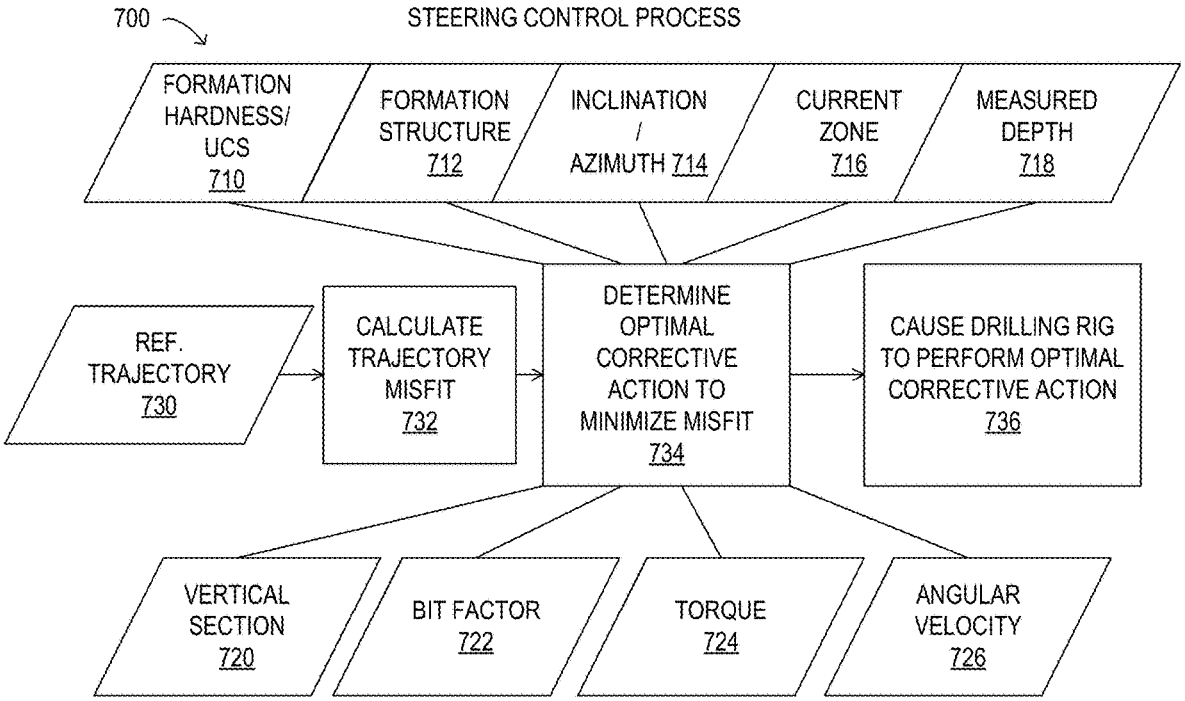
FIG. 7 is a depiction of a steering control process used by the rig control systems.

FIG. 7 illustrates one embodiment of a steering control process 700 for determining an optimal corrective action for drilling. Steering control process 700 may be used for rotary drilling or slide drilling in different embodiments.

Steering control process 700 in FIG. 7 illustrates a variety of inputs that can be used to determine an optimum corrective action. As shown in FIG. 7, the inputs include formation hardness/unconfined compressive strength (UCS) 710, formation structure 712, inclination/azimuth 714, current zone 716, measured depth 718, desired tool face, vertical section 720, bit factor 722, mud motor torque 724, reference trajectory 730, vertical section 720, bit factor 722, torque 724 and angular velocity 726. In FIG. 7, reference trajectory 730 of borehole 106 is determined to calculate a trajectory misfit in a step 732. Step 732 may output the trajectory misfit to determine an optimal corrective action to minimize the misfit at step 734, which may be performed using the other inputs described above. Then, at step 736, the drilling rig is caused to perform the optimal corrective action.

It is noted that in some implementations, at least certain portions of steering control process 700 may be automated or performed without user intervention, such as using rig control systems 700 (see FIG. 7). In other implementations, the optimal corrective action in step 736 may be provided or communicated (by display, SMS message, email, or otherwise) to one or more human operators, who may then take appropriate action. The human operators may be members of a rig crew, which may be located at or near drilling rig 210 or may be located remotely from drilling rig 210.

Figure 8:
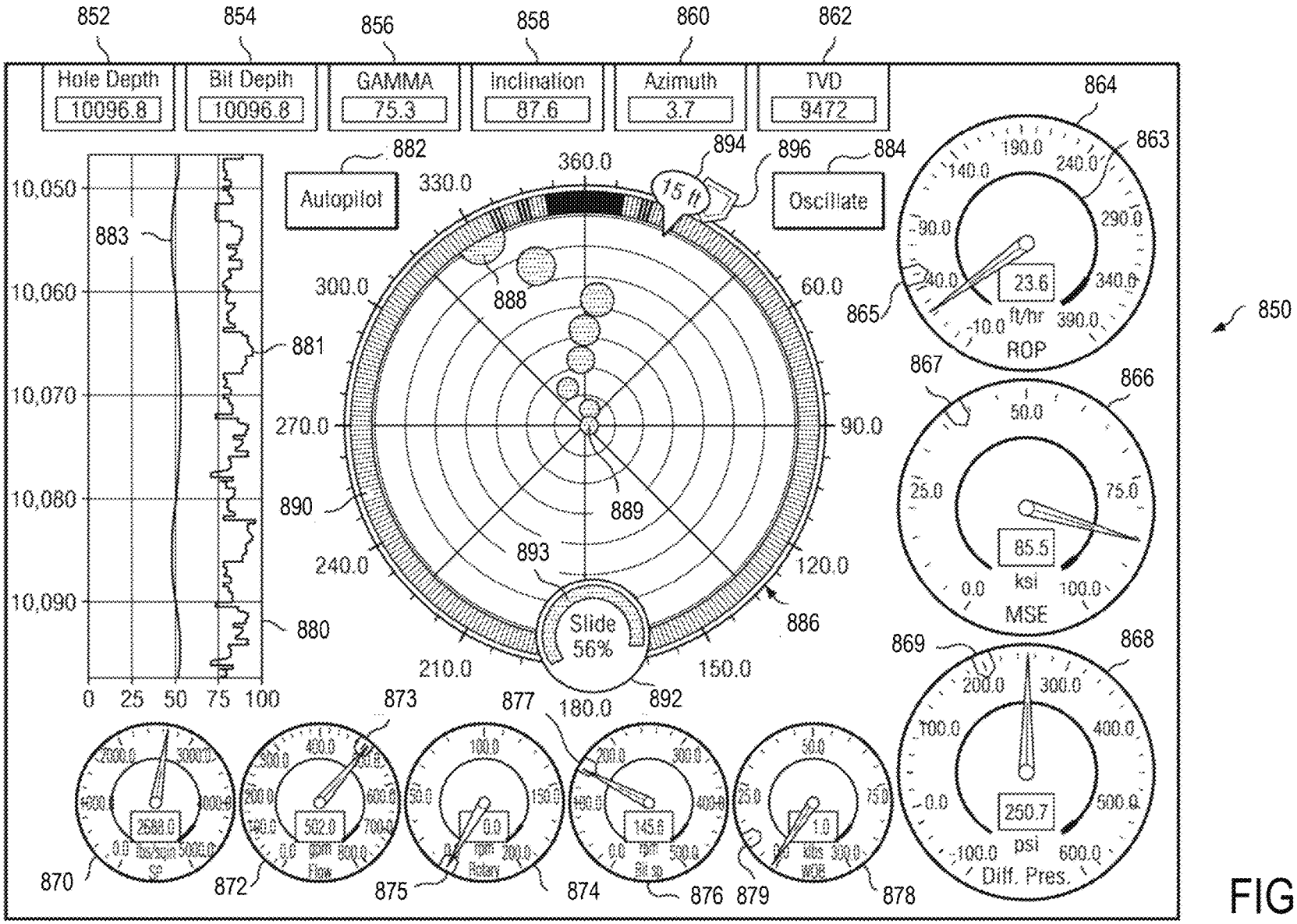
FIG. 8 is a depiction of a graphical user interface provided by the rig control systems.

Referring to FIG. 8, one embodiment of a user interface 850 that may be generated by steering control system 168 for monitoring and operation by a human operator is illustrated. User interface 850 may provide many different types of information in an easily accessible format. For example, user interface 850 may be shown on a computer monitor, a television, a viewing screen (e.g., a display device) associated with steering control system 168.

As shown in FIG. 8, user interface 850 provides visual indicators such as a hole depth indicator 852, a bit depth indicator 854, a GAMMA indicator 856, an inclination indicator 858, an azimuth indicator 860, and a TVD indicator 862. Other indicators may also be provided, including a ROP indicator 864, a mechanical specific energy (MSE) indicator 866, a differential pressure indicator 868, a standpipe pressure indicator 870, a flow rate indicator 872, a rotary RPM (angular velocity) indicator 874, a bit speed indicator 876, and a WOB indicator 878.

In FIG. 8, at least some of indicators 864, 866, 868, 870, 872, 874, 876, and 878 may include a marker representing a target value. For example, markers may be set as certain given values, but it is noted that any desired target value may be used. Although not shown, in some embodiments, multiple markers may be present on a single indicator. The markers may vary in color or size. For example, ROP indicator 864 may include a marker 865 indicating that the target value is 50 feet/hour (or 15 m/h). MSE indicator 866 may include a marker 867 indicating that the target value is 37 kilo pounds per square inch (ksi) or 255 Megapascals (MPa). Differential pressure indicator 868 may include a marker 869 indicating that the target value is 200 psi (or 1.38 kPa). ROP indicator 864 may include a marker 865 indicating that the target value is 50 feet/hour (or 15 m/h). Standpipe pressure indicator 870 may have no marker in the present example. Flow rate indicator 872 may include a marker 873 indicating that the target value is 500 gallons per minute (gpm) (or 31.5 liters per second (L/s)). Rotary RPM indicator 874 may include a marker 875 indicating that the target value is 0 RPM (e.g., due to sliding). Bit speed indicator 876 may include a marker 877 indicating that the target value is 150 RPM. WOB indicator 878 may include a marker 879 indicating that the target value is 10 kilo pounds (klbs) (or 4,500 kilograms (kg)). Each indicator may also include a colored band, or another marking, to indicate, for example, whether the respective gauge value is within a safe range (e.g., indicated by a green color), within a caution range (e.g., indicated by a yellow color), or within a danger range (e.g., indicated by a red color).

In FIG. 8, a log chart 880 may visually indicate depth versus one or more measurements (e.g., may represent log inputs relative to a progressing depth chart). For example, log chart 880 may have a Y-axis representing depth and an X-axis representing a measurement such as GAMMA count 881 (as shown), ROP 883 (e.g., empirical ROP and normalized ROP), or resistivity. An autopilot button 882 and an oscillate button 884 may be used to control activity. For example, autopilot button 882 may be used to engage or disengage autodriller 510, while oscillate button 884 may be used to directly control oscillation of drill string 146 or to engage/disengage an external hardware device or controller.

In FIG. 8, a circular chart 886 may provide current and historical tool face orientation information (e.g., which way the bend is pointed). For purposes of illustration, circular chart 886 represents three hundred and sixty degrees. A series of circles within circular chart 886 may represent a timeline of tool face orientations, with the sizes of the circles indicating the temporal position of each circle. For example, larger circles may be more recent than smaller circles, so a largest circle 888 may be the newest reading and a smallest circle 889 may be the oldest reading. In other embodiments, circles 889, 888 may represent the energy or progress made via size, color, shape, a number within a circle, etc. For example, a size of a particular circle may represent an accumulation of orientation and progress for the period of time represented by the circle. In other embodiments, concentric circles representing time (e.g., with the outside of circular chart 886 being the most recent time and the center point being the oldest time) may be used to indicate the energy or progress (e.g., via color or patterning such as dashes or dots rather than a solid line).

In user interface 850, circular chart 886 may also be color coded, with the color coding existing in a band 890 around circular chart 886 or positioned or represented in other ways. The color coding may use colors to indicate activity in a certain direction. For example, the color red may indicate the highest level of activity, while the color blue may indicate the lowest level of activity. Furthermore, the arc range in degrees of a color may indicate the amount of deviation. Accordingly, a relatively narrow (e.g., thirty degrees) arc of red with a relatively broad (e.g., three hundred degrees) arc of blue may indicate that most activity is occurring in a particular tool face orientation with little deviation. As shown in user interface 850, the color blue may extend from approximately 22-337 degrees, the color green may extend from approximately 15-22 degrees and 337-345 degrees, the color yellow may extend a few degrees around the 13 and 345 degree marks, while the color red may extend from approximately 347-10 degrees. Transition colors or shades may be used with, for example, the color orange marking the transition between red and yellow or a light blue marking the transition between blue and green. This color coding may enable user interface 850 to provide an intuitive summary of how narrow the standard deviation is and how much of the energy intensity is being expended in the proper direction. Furthermore, the center of energy may be viewed relative to the target. For example, user interface 850 may clearly show that the target is at 90 degrees, but the center of energy is at 45 degrees.

In user interface 850, other indicators, such as a slide indicator 892, may indicate how much time remains until a slide occurs or how much time remains for a current slide. For example, slide indicator 892 may represent a time, a percentage (e.g., as shown, a current slide may be 56% complete), a distance completed, or a distance remaining. Slide indicator 892 may graphically display information using, for example, a colored bar 893 that increases or decreases with slide progress. In some embodiments, slide indicator 892 may be built into circular chart 886 (e.g., around the outer edge with an increasing/decreasing band), while in other embodiments slide indicator 892 may be a separate indicator such as a meter, a bar, a gauge, or another indicator type. In various implementations, slide indicator 892 may be refreshed by autoslide 514.

In user interface 850, an error indicator 894 may indicate a magnitude and a direction of error. For example, error indicator 894 may indicate that an estimated drill bit position is a certain distance from the planned trajectory, with a location of error indicator 894 around the circular chart 886 representing the heading. For example, FIG. 8 illustrates an error magnitude of 15 feet and an error direction of 15 degrees. Error indicator 894 may be any color but may be red for purposes of example. It is noted that error indicator 894 may present a zero if there is no error. Error indicator may represent that drill bit 148 is on the planned trajectory using other means, such as being a green color. Transition colors, such as yellow, may be used to indicate varying amounts of error. In some embodiments, error indicator 894 may not appear unless there is an error in magnitude or direction. A marker 896 may indicate an ideal slide direction. Although not shown, other indicators may be present, such as a bit life indicator to indicate an estimated lifetime for the current bit based on a value such as time or distance.

It is noted that user interface 850 may be arranged in many different ways. For example, colors may be used to indicate normal operation, warnings, and problems. In such cases, the numerical indicators may display numbers in one color (e.g., green) for normal operation, may use another color (e.g., yellow) for warnings, and may use yet another color (e.g., red) when a serious problem occurs. The indicators may also flash or otherwise indicate an alert. The gauge indicators may include colors (e.g., green, yellow, and red) to indicate operational conditions and may also indicate the target value (e.g., an ROP of 100 feet/hour). For example, ROP indicator 868 may have a green bar to indicate a normal level of operation (e.g., from 10-300 feet/hour), a yellow bar to indicate a warning level of operation (e.g., from 300-360 feet/hour), and a red bar to indicate a dangerous or otherwise out of parameter level of operation (e.g., from 360-390 feet/hour). ROP indicator 868 may also display a marker at 100 feet/hour to indicate the desired target ROP.

Furthermore, the use of numeric indicators, gauges, and similar visual display indicators may be varied based on factors such as the information to be conveyed and the personal preference of the viewer. Accordingly, user interface 850 may provide a customizable view of various drilling processes and information for a particular individual involved in the drilling process. For example, steering control system 168 may enable a user to customize the user interface 850 as desired, although certain features (e.g., standpipe pressure) may be locked to prevent a user from intentionally or accidentally removing important drilling information from user interface 850. Other features and attributes of user interface 850 may be set by user preference. Accordingly, the level of customization and the information shown by the user interface 850 may be controlled based on who is viewing user interface 850 and their role in the drilling process.

Figure 9:
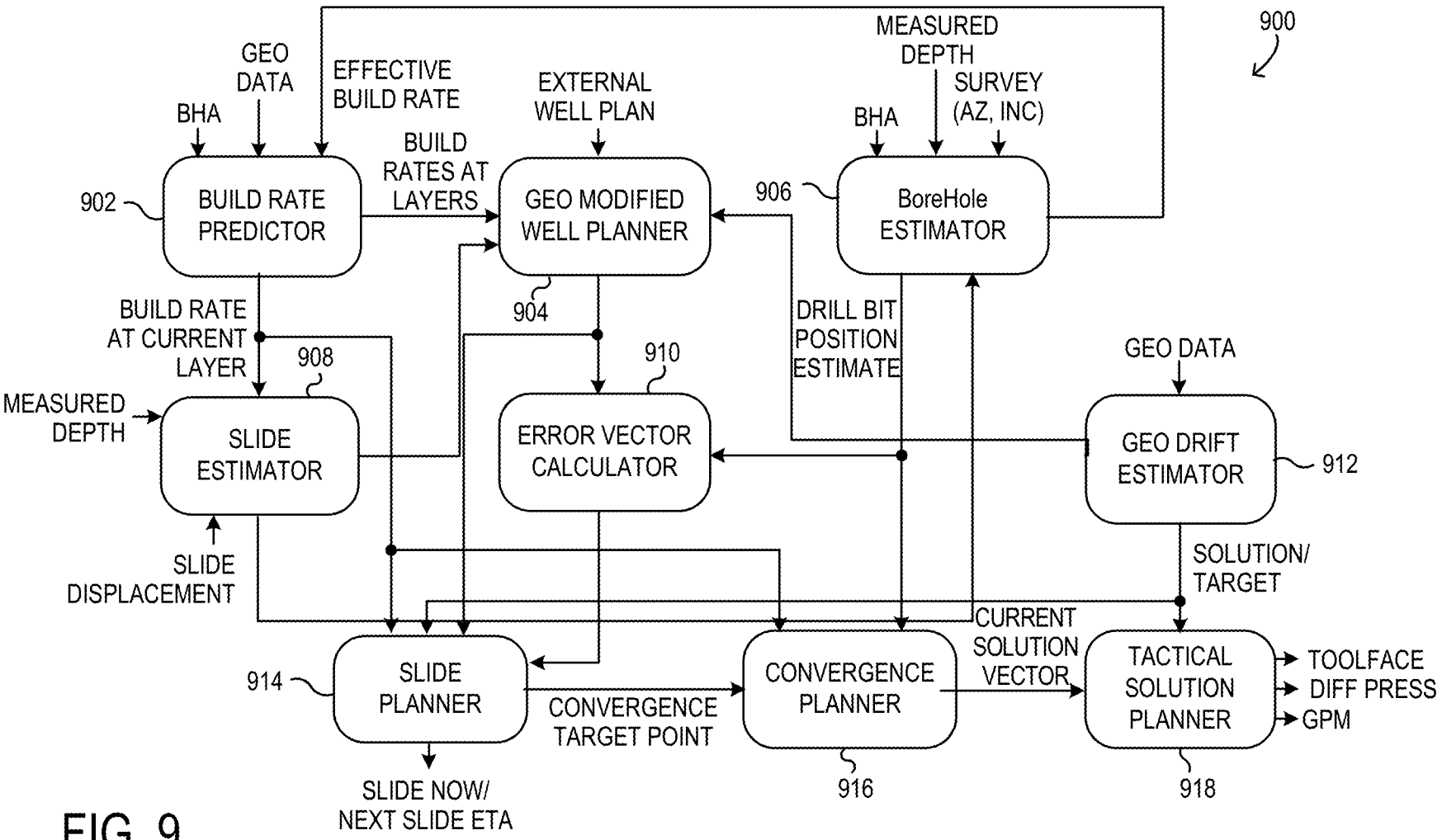
FIG. 9 is a depiction of a guidance control loop performed by the rig control systems.

Referring to FIG. 9, one embodiment of a guidance control loop (GCL) 900 is shown in further detail GCL 900 may represent one example of a control loop or control algorithm executed under the control of steering control system 168. GCL 900 may include various functional modules, including a build rate predictor 902, a geo modified well planner 904, a borehole estimator 906, a slide estimator 908, an error vector calculator 910, a geological drift estimator 912, a slide planner 914, a convergence planner 916, and a tactical solution planner 918. In the following description of GCL 900, the term "external input" refers to input received from outside GCL 900, while "internal input" refers to input exchanged between functional modules of GCL 900.

In FIG. 9, build rate predictor 902 receives external input representing BHA information and geological information, receives internal input from the borehole estimator 906, and provides output to geo modified well planner 904, slide estimator 908, slide planner 914, and convergence planner 916. Build rate predictor 902 is configured to use the BHA information and geological information to predict drilling build rates of current and future sections of borehole 106. For example, build rate predictor 902 may determine how aggressively a curve will be built for a given formation with BHA 149 and other equipment parameters.

In FIG. 9, build rate predictor 902 may use the orientation of BHA 149 to the formation to determine an angle of attack for formation transitions and build rates within a single layer of a formation. For example, if a strata layer of rock is below a strata layer of sand, a formation transition exists between the strata layer of sand and the strata layer of rock. Approaching the strata layer of rock at a 90 degree angle may provide a good tool face and a clean drill entry, while approaching the rock layer at a 45 degree angle may build a curve relatively quickly. An angle of approach that is near parallel may cause drill bit 148 to skip off the upper surface of the strata layer of rock. Accordingly, build rate predictor 902 may calculate BHA orientation to account for formation transitions. Within a single strata layer, build rate predictor 902 may use the BHA orientation to account for internal layer characteristics (e.g., grain) to determine build rates for different parts of a strata layer. The BHA information may include bit characteristics, mud motor bend setting, stabilization, and mud motor bit to bend distance. The geological information may include formation data such as compressive strength, thicknesses, and depths for formations encountered in the specific drilling location. Such information may enable a calculation-based prediction of the build rates and ROP that may be compared to both results obtained while drilling borehole 106 and regional historical results (e.g., from the regional drilling DB 412) to improve the accuracy of predictions as drilling progresses. Build rate predictor 902 may also be used to plan convergence adjustments and confirm in advance of drilling that targets can be achieved with current parameters.

In FIG. 9, geo modified well planner 904 receives external input representing a well plan, internal input from build rate predictor 902 and geo drift estimator 912 and provides output to slide planner 914 and error vector calculator 910. Geo modified well planner 904 uses the input to determine whether there is a more optimal trajectory than that provided by the well plan, while staying within specified error limits. More specifically, geo modified well planner 904 takes geological information (e.g., drift) and calculates whether another trajectory solution to the target may be more efficient in terms of cost or reliability. The outputs of geo modified well planner 904 to slide planner 914 and error vector calculator 910 may be used to calculate an error vector based on the current vector to the newly calculated trajectory and to modify slide predictions. In some embodiments, geo modified well planner 904 (or another module) may provide functionality needed to track a formation trend. For example, in horizontal wells, a geologist may provide steering control system 168 with a target inclination as a set point for steering control system 168 to control. For example, the geologist may enter a target to steering control system 168 of 90.5-91.0 degrees of inclination for a section of borehole 106. Geo modified well planner 904 may then treat the target as a vector target, while remaining within the error limits of the original well plan. In some embodiments, geo modified well planner 904 may be an optional module that is not used unless the well plan is to be modified. For example, if the well plan is marked in steering control system 168 as non-modifiable, geo modified well planner 904 may be bypassed altogether or geo modified well planner 904 may be configured to pass the well plan through without any changes.

In FIG. 9, borehole estimator 906 may receive external inputs representing BHA information, measured depth information, survey information (e.g., azimuth and inclination), and may provide outputs to build rate predictor 902, error vector calculator 910, and convergence planner 916. Borehole estimator 906 may be configured to provide an estimate of the actual borehole and drill bit position and trajectory angle without delay, based on either straight line projections or projections that incorporate sliding. Borehole estimator 906 may be used to compensate for a sensor being physically located some distance behind drill bit 148 (e.g., 50 feet) in drill string 146, which makes sensor readings lag the actual bit location by 50 feet. Borehole estimator 906 may also be used to compensate for sensor measurements that may not be continuous (e.g., a sensor measurement may occur every 100 feet). Borehole estimator 906 may provide the most accurate estimate from the surface to the last survey location based on the collection of survey measurements. Also, borehole estimator 906 may take the slide estimate from slide estimator 908 (described below) and extend the slide estimate from the last survey point to a current location of drill bit 148. Using the combination of these two estimates, borehole estimator 906 may provide steering control system 168 with an estimate of the drill bit's location and trajectory angle from which guidance and steering solutions can be derived. An additional metric that can be derived from the borehole estimate is the effective build rate that is achieved throughout the drilling process.

In FIG. 9, slide estimator 908 receives external inputs representing measured depth and differential pressure information, receives internal input from build rate predictor 902, and provides output to borehole estimator 906 and geo modified well planner 904. Slide estimator 908 may be configured to sample tool face orientation, differential pressure, measured depth (MD) incremental movement, MSE, and other sensor feedback to quantify/estimate a deviation vector and progress while sliding.

Traditionally, deviation from the slide would be predicted by a human operator based on experience. The operator would, for example, use a long slide cycle to assess what likely was accomplished during the last slide. However, the results are generally not confirmed until the downhole survey sensor point passes the slide portion of the borehole, often resulting in a response lag defined by a distance of the sensor point from the drill bit tip (e.g., approximately 50 feet). Such a response lag may introduce inefficiencies in the slide cycles due to over/under correction of the actual trajectory relative to the planned trajectory.

In GCL 900, using slide estimator 908, each tool face update may be algorithmically merged with the average differential pressure of the period between the previous and current tool face readings, as well as the MD change during this period to predict the direction, angular deviation, and MD progress during the period. As an example, the periodic rate may be between 10 and 60 seconds per cycle depending on the tool face update rate of downhole tool 166. With a more accurate estimation of the slide effectiveness, the sliding efficiency can be improved. The output of slide estimator 908 may accordingly be periodically provided to borehole estimator 906 for accumulation of well deviation information, as well to geo modified well planner 904. Some or all of the output of the slide estimator 908 may be output to an operator, such as shown in the user interface 850 of FIG. 8.

In FIG. 9, error vector calculator 910 may receive internal input from geo modified well planner 904 and borehole estimator 906. Error vector calculator 910 may be configured to compare the planned well trajectory to an actual borehole trajectory and drill bit position estimate. Error vector calculator 910 may provide the metrics used to determine the error (e.g., how far off) the current drill bit position and trajectory are from the well plan. For example, error vector calculator 910 may calculate the error between the current bit position and trajectory to the planned trajectory and the desired bit position. Error vector calculator 910 may also calculate a projected bit position/projected trajectory representing the future result of a current error.

In FIG. 9, geological drift estimator 912 receives external input representing geological information and provides outputs to geo modified well planner 904, slide planner 914, and tactical solution planner 918. During drilling, drift may occur as the particular characteristics of the formation affect the drilling direction. More specifically, there may be a trajectory bias that is contributed by the formation as a function of ROP and BHA 149. Geological drift estimator 912 is configured to provide a drift estimate as a vector that can then be used to calculate drift compensation parameters that can be used to offset the drift in a control solution.

In FIG. 9, slide planner 914 receives internal input from build rate predictor 902, geo modified well planner 904, error vector calculator 910, and geological drift estimator 912, and provides output to convergence planner 916 as well as an estimated time to the next slide. Slide planner 914 may be configured to evaluate a slide/drill ahead cost equation and plan for sliding activity, which may include factoring in BHA wear, expected build rates of current and expected formations, and the well plan trajectory. During drill ahead, slide planner 914 may attempt to forecast an estimated time of the next slide to aid with planning. For example, if additional lubricants (e.g., fluorinated beads) are indicated for the next slide, and pumping the lubricants into drill string 146 has a lead time of 30 minutes before the slide, the estimated time of the next slide may be calculated and then used to schedule when to start pumping the lubricants. Functionality for a loss circulation material (LCM) planner may be provided as part of slide planner 914 or elsewhere (e.g., as a stand-alone module or as part of another module described herein). The LCM planner functionality may be configured to determine whether additives should be pumped into the borehole based on indications such as flow-in versus flow-back measurements. For example, if drilling through a porous rock formation, fluid being pumped into the borehole may get lost in the rock formation. To address this issue, the LCM planner may control pumping LCM into the borehole to clog up the holes in the porous rock surrounding the borehole to establish a more closed-loop control system for the fluid.

In FIG. 9, slide planner 914 may also look at the current position relative to the next connection. A connection may happen every 90 to 100 feet (or some other distance or distance range based on the particulars of the drilling operation) and slide planner 914 may avoid planning a slide when close to a connection or when the slide would carry through the connection. For example, if the slide planner 914 is planning a 50 foot slide but only 20 feet remain until the next connection, slide planner 914 may calculate the slide starting after the next connection and make any changes to the slide parameters to accommodate waiting to slide until after the next connection. Such flexible implementation avoids inefficiencies that may be caused by starting the slide, stopping for the connection, and then having to reorient the tool face before finishing the slide. During slides, slide planner 914 may provide some feedback as to the progress of achieving the desired goal of the current slide. In some embodiments, slide planner 914 may account for reactive torque in the drill string. More specifically, when rotating is occurring, there is a reactional torque wind up in drill string 146. When the rotating is stopped, drill string 146 unwinds, which changes tool face orientation and other parameters. When rotating is started again, drill string 146 starts to wind back up. Slide planner 914 may account for the reactional torque so that tool face references are maintained, rather than stopping rotation and then trying to adjust to an optimal tool face orientation. While not all downhole tools may provide tool face orientation when rotating, using one that does supply such information for GCL 900 may significantly reduce the transition time from rotating to sliding.

In FIG. 9, convergence planner 916 receives internal inputs from build rate predictor 902, borehole estimator 906, and slide planner 914, and provides output to tactical solution planner 918. Convergence planner 916 is configured to provide a convergence plan when the current drill bit position is not within a defined margin of error of the planned well trajectory. The convergence plan represents a path from the current drill bit position to an achievable and optimal convergence target point along the planned trajectory. The convergence plan may take account the amount of sliding/drilling ahead that has been planned to take place by slide planner 914. Convergence planner 916 may also use BHA orientation information for angle of attack calculations when determining convergence plans as described above with respect to build rate predictor 902. The solution provided by convergence planner 916 defines a new trajectory solution for the current position of drill bit 148. The solution may be immediate without delay or planned for implementation at a future time that is specified in advance.

In FIG. 9, tactical solution planner 918 receives internal inputs from geological drift estimator 912 and convergence planner 916 and provides external outputs representing information such as tool face orientation, differential pressure, and mud flow rate. Tactical solution planner 918 is configured to take the trajectory solution provided by convergence planner 916 and translate the solution into control parameters that can be used to control drilling rig 210. For example, tactical solution planner 918 may convert the solution into settings for control systems 522, 524, and 526 to accomplish the actual drilling based on the solution. Tactical solution planner 918 may also perform performance optimization to optimizing the overall drilling operation as well as optimizing the drilling itself (e.g., how to drill faster).

Other functionality may be provided by GCL 900 in additional modules or added to an existing module. For example, there is a relationship between the rotational position of the drill pipe on the surface and the orientation of the downhole tool face. Accordingly, GCL 900 may receive information corresponding to the rotational position of the drill pipe on the surface. GCL 900 may use this surface positional information to calculate current and desired tool face orientations. These calculations may then be used to define control parameters for adjusting the top drive 140 to accomplish adjustments to the downhole tool face in order to steer the trajectory of borehole 106.

For purposes of example, an object-oriented software approach may be utilized to provide a class-based structure that may be used with GCL 900, or other functionality provided by steering control system 168. In GCL 900, a drilling model class may be defined to capture and define the drilling state throughout the drilling process. The drilling model class may include information obtained without delay. The drilling model class may be based on the following components and sub-models: a drill bit model, a borehole model, a rig surface gear model, a mud pump model, a WOB/differential pressure model, a positional/rotary model, an MSE model, an active well plan, and control limits. The drilling model class may produce a control output solution and may be executed via a main processing loop that rotates through the various modules of GCL 900. The drill bit model may represent the current position and state of drill bit 148. The drill bit model may include a three dimensional (3D) position, a drill bit trajectory, BHA information, bit speed, and tool face (e.g., orientation information). The 3D position may be specified in north-south (NS), east-west (EW), and true vertical depth (TVD). The drill bit trajectory may be specified as an inclination angle and an azimuth angle. The BHA information may be a set of dimensions defining the active BHA. The borehole model may represent the current path and size of the active borehole. The borehole model may include hole depth information, an array of survey points collected along the borehole path, a gamma log, and borehole diameters. The hole depth information is for current drilling of borehole 106. The borehole diameters may represent the diameters of borehole 106 as drilled over current drilling. The rig surface gear model may represent pipe length, block height, and other models, such as the mud pump model, WOB/differential pressure model, positional/rotary model, and MSE model. The mud pump model represents mud pump equipment and includes flow rate, standpipe pressure, and differential pressure. The WOB/differential pressure model represents draw works or other WOB/differential pressure controls and parameters, including WOB. The positional/rotary model represents top drive or other positional/rotary controls and parameters including rotary RPM and spindle position. The active well plan represents the target borehole path and may include an external well plan and a modified well plan. The control limits represent defined parameters that may be set as maximums and/or minimums. For example, control limits may be set for the rotary RPM in the top drive model to limit the maximum rotations per minute (RPMs) to the defined level. The control output solution may represent the control parameters for drilling rig 210.

Each functional module of GCL 900 may have behavior encapsulated within a respective class definition. During a processing window, the individual functional modules may have an exclusive portion in time to execute and update the drilling model. For purposes of example, the processing order for the functional modules may be in the sequence of geo modified well planner 904, build rate predictor 902, slide estimator 908, borehole estimator 906, error vector calculator 910, slide planner 914, convergence planner 916, geological drift estimator 912, and tactical solution planner 918. It is noted that other sequences may be used in different implementations.

In FIG. 9, GCL 900 may rely on a programmable timer module that provides a timing mechanism to provide timer event signals to drive the main processing loop. While steering control system 168 may rely on timer and date calls driven by the programming environment, timing may be obtained from other sources than system time. In situations where it may be advantageous to manipulate the clock (e.g., for evaluation and testing), a programmable timer module may be used to alter the system time. For example, the programmable timer module may enable a default time set to the system time and a time scale of 1.0, may enable the system time of steering control system 168 to be manually set, may enable the time scale relative to the system time to be modified, or may enable periodic event time requests scaled to a requested time scale.

Referring now to FIG. 10, a block diagram illustrating selected elements of an embodiment of a controller 1000 for performing surface steering according to the present disclosure. In various embodiments, controller 1000 may represent an implementation of steering control system 168. In other embodiments, at least certain portions of controller 1000 may be used for control systems 510, 512, 514, 522, 524, and 526 (see FIG. 5).

In the embodiment depicted in FIG. 10, controller 1000 includes processor 1001 coupled via shared bus 1002 to storage media collectively identified as memory media 1010.

Controller 1000, as depicted in FIG. 10, further includes network adapter 1020 that interfaces controller 1000 to a network (not shown in FIG. 10). In embodiments suitable for use with user interfaces, controller 1000, as depicted in FIG. 10, may include peripheral adapter 1006, which provides connectivity for the use of input device 1008 and output device 1009. Input device 1008 may represent a device for user input, such as a keyboard or a mouse, or even a video camera. Output device 1009 may represent a device for providing signals or indications to a user, such as loudspeakers for generating audio signals.

Controller 1000 is shown in FIG. 10 including display adapter 1004 and further includes a display device 1005. Display adapter 1004 may interface shared bus 1002, or another bus, with an output port for one or more display devices, such as display device 1005. Display device 1005 may be implemented as a liquid crystal display screen, a computer monitor, a television or the like. Display device 1005 may comply with a display standard for the corresponding type of display. Standards for computer monitors include analog standards such as video graphics array (VGA), extended graphics array (XGA), etc., or digital standards such as digital visual interface (DVI), definition multimedia interface (HDMI), among others. A television display may comply with standards such as NTSC (National Television System Committee), PAL (Phase Alternating Line), or another suitable standard. Display device 1005 may include an output device 1009, such as one or more integrated speakers to play audio content, or may include an input device 1008, such as a microphone or video camera.

In FIG. 10, memory media 1010 encompasses persistent and volatile media, fixed and removable media, and magnetic and semiconductor media. Memory media 1010 is operable to store instructions, data, or both. Memory media 1010 as shown includes sets or sequences of instructions 1024-2, namely, an operating system 1012 and surface steering control 1014. Operating system 1012 may be a UNIX or UNIX-like operating system, a Windows® family operating system, or another suitable operating system. Instructions 1024 may also reside, completely or at least partially, within processor 1001 during execution thereof. It is further noted that processor 1001 may be configured to receive instructions 1024-1 from instructions 1024-2 via shared bus 1002. In some embodiments, memory media 1010 is configured to store and provide executable instructions for executing GCL 900, as mentioned previously, among other methods and operations disclosed herein.

Zeroing

Estimation of downhole weight on bit (DWOB) and differential pressure may be important for control and optimization of drilling operations. Embodiments provide a method for zeroing tension and pressure for various operations such as rotary drilling and sliding, in vertical, curve, and lateral, without using a downhole sensor. Embodiments may use a torque-and-drag model for predicting a zero tension (e.g., for zeroing) or a fluid friction model for zeroing pressure. The disclosed systems and methods should improve consistency and accuracy in drilling. It should be noted that the methods disclosed herein may be automated, such as by programming control system 168 or controller 1000 or yet another computer control system to automatically control and perform the operations described herein.

Hook load can be an important parameter used during drilling operations to control the weight on bit and assess possible deteriorations of the downhole conditions such as poor hole cleaning or excessive tortuosity. The hook load is normally measured indirectly, either in the travelling equipment or as a tension in the deadline. The apparent hook load is subject to load-generating forces between the measurement location and the top of the string, including the weight of the mud hose attached to the top of the drive, imperfect tension transmission across sheaves and gravitational and inertia forces associated with weight and rotation of the drill line, respectively. The load contribution from these forces can amount to several metric tons, and this must be accounted for whenever the true hook load is to be derived.

Automated zeroing of the weight-on-bit (WOB) and differential pressure setpoint and helps ensure proper contact with the formation. Automated, configurable, consistent bit engagement ultimately reduces BHA failures and decreases time to target. Full stand control means a driller can return to bottom from any point during a stand after engaging bottom (sliding or rotating), improving back to bottom times and lessening exposure to manual bit engagement variances. Off bottom RPM reduction automatically slows the top drive to help prevent harmful drillstring vibrations. Surveys on the fly decrease flat time/off bottom time spent waiting for surveys before drilling operations can resume.

Automated zeroing features can reduce failures and repairs. The features can lower risk of damaging downhole tools by reengaging the bit in a controlled and repeatable manner. The zeroing features can reduce torsional and lateral vibration and helps ensure accuracy and consistency during drilling.

Automated zeroing can lower operational costs through less costly bit and BHA damage from zeroing errors that lead to underestimation of operating conditions, improved consistency drives lower cost per foot, and avoiding unplanned trips during drilling. In some cases, errors in zeroing can lead to underestimation of WOB or differential pressure which are estimated based on zero values.

Figure 11:
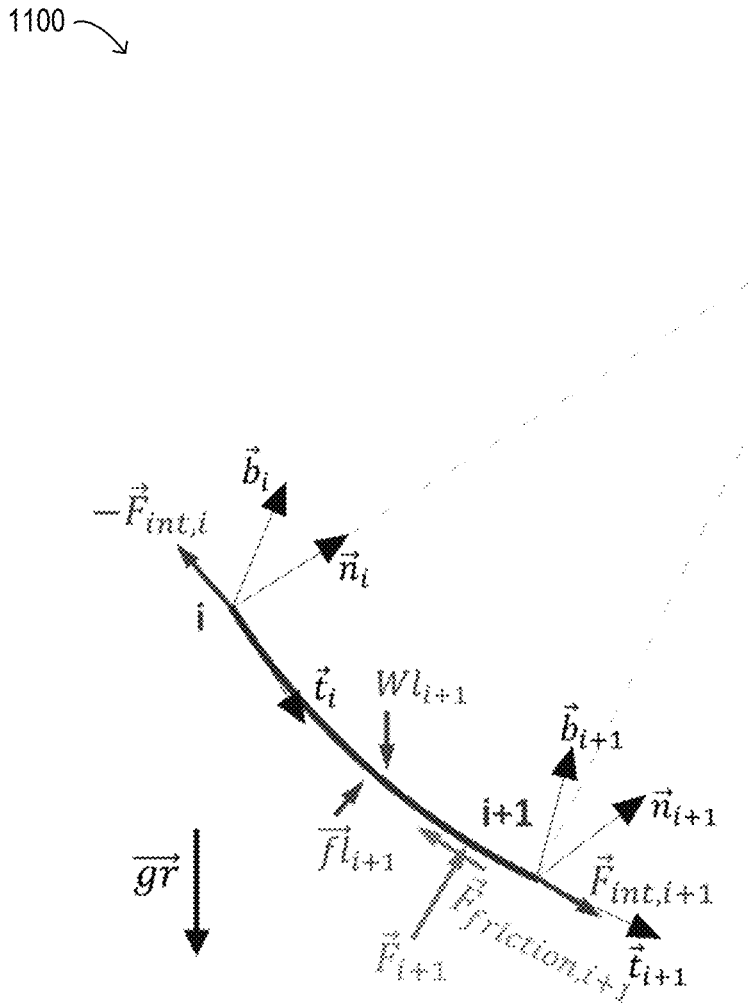
FIG. 11 illustrates an exemplary force distribution diagram for equilibrium for a drill string element.

FIG. 11 illustrates an exemplary force distribution diagram for equilibrium for a drill string element 1100. In this figure, $\vec{t}_i$ is the tangent vector of the string at the node i. ($\vec{t}_i$, $\vec{n}_i$, $\vec{b}_i$) represents the local axis of the node i. $\vec{n}_i$ and $\vec{b}_i$ are therefore two perpendicular vectors in the string cross section at the node i. In the case where $\vec{t}_i$ and $\vec{t}_{i+1}$ are not co-linear, $\vec{n}_i$, $\vec{b}_i$ can be given as:

$$\begin{cases} \vec{b}_i = \vec{t}_{i+1} \wedge \vec{t}_i \\ \vec{n}_i = \vec{t}_i \wedge \vec{b}_i \end{cases}$$

Considering the force equilibrium of element:

$$-\vec{F}_{int,i}+\vec{F}_{int,i+1}+\vec{F}_{i+1}+\vec{F}_{friction}+Wl_{i+1}L_{i+1}\vec{gr}+\vec{fl}_{i+1}L_{i+1}=\vec{0}$$

$$-T_i\vec{t}_i+\vec{F}_{intlat,i}+T_{i+1}\vec{t}_{i+1}+\vec{F}_{intlat,i+1}+\vec{F}_{i+1}+\vec{F}_{friction}+Wl_{i+1}L_{i+1}\vec{gr}+\vec{fl}_{i+1}L_{i+1}=\vec{0}$$

where:

+$L_{i+1}$ is the length of the string element.

+$Wl_{i+1}$ is the weight per unit length of the string element.

+$\vec{gr}$ is the gravity vector.

+$\vec{fl}_{i+1}$ is the additional linear external loading on the string element.

+$\vec{F}_{int,i}$ is the internal force in the structure at the node i:

$$\vec{F}_{int,i}=T_i\vec{t}_i+\vec{F}_{intlat,i}$$

+$T_i$ is the tension at the node i.

+$\vec{F}_{intlat,i}$ is the lateral component of $\vec{F}_{int,i}$ (shear force).

+$\vec{F}_{i+1}+\vec{F}_{friction,i+1}$ represents the total contact force between string and wellbore along the element (i, i+1)

By approximating that the total contact force along the element (i, i+1) are concentrated at the node i for the bottom to surface model, the normal contact force at the node i is therefore given as:

$$\vec{F}_{c,i}=\vec{F}_{n,i}+\vec{F}_{b,i}=F_{n,i}\vec{n}_i+F_{b,i}\vec{b}_i$$

$$F_{c,i}=\sqrt{F_{n,i}^2+F_{b,i}^2}$$

The total friction force is:

$$\vec{F}_{fric,i}=-\mu_a F_{c,i}\vec{t}_i-\mu_r\vec{t}_i\wedge\vec{F}_{c,i}$$

$$\vec{F}_{fric,i}=-\mu_a F_{c,i}\vec{t}_i+\mu_r F_{n,i}\vec{b}_i-\mu_r F_{b,i}\vec{n}_i$$

The friction torque is:

$$M_{t,fric,i}=\mu_r\cdot R_{i+1}\cdot F_{c,i}$$

Where:

+$R_{i+1}$ is the radius for the torque of the element (i, i+1).

+$\mu_a$, $\mu_r$ are axial & tangential friction coefficient.

By replacing this total contact force in the element equilibrium equation, it becomes:

$$-T_i\vec{t}_i+\vec{F}_{intlat,i}+T_{i+1}\vec{t}_{t+1}+\vec{F}_{intlat,i+1}+F_{n,i}\vec{n}_i+F_{b,i}\vec{b}_i-\mu_a F_{c,i}\vec{t}_i+\mu_r F_{n,i}\vec{b}_i-\mu_r F_{b,i}\vec{n}_i$$

$$+Wl_{i+1}L_{i+1}\vec{gr}+\vec{fl}_{i+1}L_{i+1}=\vec{0}$$

Figure 12:
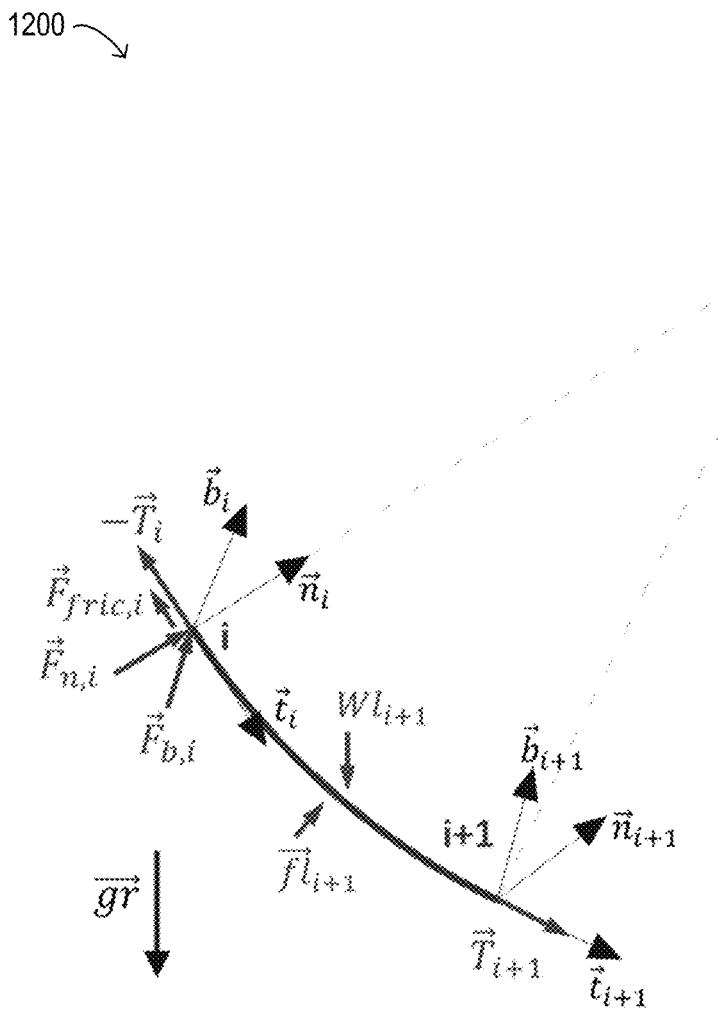
FIG. 12 illustrates a normal contact force model for a drill string element.

FIG. 12 illustrates the equilibrium for a drill string element 1200 by ignoring the shear forces (lateral component of the internal forces) and the tangential friction forces.

By projecting the equilibrium equation in the directions $\vec{n}_i$ and $\vec{b}_i$, the following equations can be used as an approximation for the normal contact force:

$$f_{n,i}=-T_{i+1}(\vec{t}_{i+1}\cdot\vec{n}_i)-Wl_{i+1}\cdot L_{i+1}(\vec{gr}\cdot\vec{n}_i)-\vec{fl}_{i+1}\cdot L_{i+1}\vec{n}_i$$

$$F_{b,i}=-Wl_{i+1}\cdot L_{i+1}\cdot(\vec{gr}\cdot\vec{b}_i)-\vec{fl}_{i+1}\cdot L_{i+1}\vec{b}_i$$

The tension at the node i in the string can be given as:

$$T_i=Wl_{i+1}\cdot L_{i+1}\cdot(\vec{gr}\cdot\vec{t}_i)+\vec{fl}_{i+1}\cdot L_{i+1}\vec{t}_i+\mu_a F_{c,i}+T_{i+1}(\vec{t}_{i+1}\cdot\vec{t}_i)$$

The torque at the node i in the string can be given as:

$$M_{t,i}=\mu_r\cdot R_{i+1}\cdot F_{c,i}+M_{t,i+1}(\vec{t}_{i+1}\cdot\vec{t}_i)$$

Figure 13:
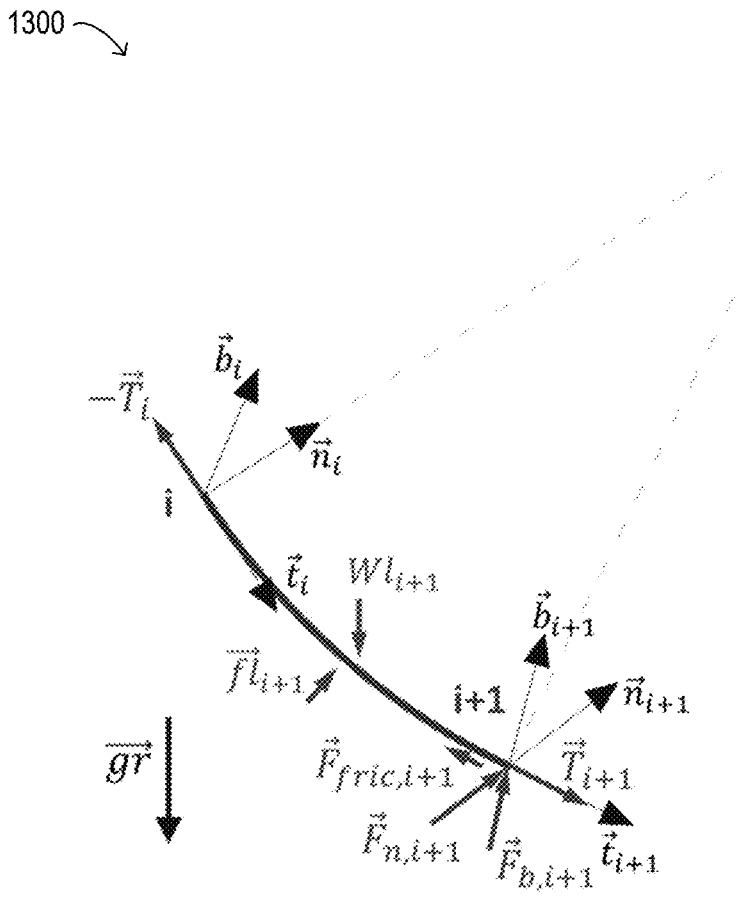
FIG. 13 illustrates a cross sectional force model for a drill string element.

FIG. 13 illustrates the equilibrium for a drill string element 1300 where the contact forces between string and wellbore along the element (i, i+1) are concentrated at the node (i+1). This approximation is used for the surface to bottom model.

The following equations of the normal contact forces at the node (i+1) can be used for the model from the surface to the bottom:

$$F_{n,i+1}=-T_i(\vec{t}_i\cdot\vec{n}_{i+1})+Wl_{i+1}\cdot L_{i+1}(\vec{gr}\cdot\vec{n}_{i+1})+\vec{fl}_{i+1}\cdot L_{i+1}\vec{n}_{i+1}$$

$$F_{b,i+1}=+Wl_{i+1}L_{i+1}(\vec{gr}\cdot\vec{b}_{i+1})+\vec{fl}_{i+1}\cdot L_{i+1}\vec{b}_{i+1}$$

$$F_{c,i+1}=\sqrt{F_{n,i}^2+F_{b,i}^2}$$

The tension and the torque at the node i+1 can be calculated by considering the inversion of the equations of the bottom to surface model, given as:

$$T_{i+1}=-Wl_{i+1}L_{i+1}(\vec{gr}\cdot\vec{t}_{i+1})-\vec{fl}_{i+1}L_{i+1}\vec{t}_{i+1}-\mu_a F_{c,i+1}+T_i/(\vec{t}_i\cdot\vec{t}_{i+1})$$

$$M_{t,i+1}=-\mu_r\cdot R_{i+1}\cdot F_{c,i+1}+M_{t,i}/(\vec{t}_i\cdot\vec{t}_{i+1})$$

This can be calculated by $(\vec{t}_i, \vec{t}_{i+1})$ by considering the inversion of the equation for the surface to bottom solution.

A mathematical model describing the forces affecting the hook load measurement can predict true hook load as a function of block position, velocity, and other conditions that can influence the measurement like mud weight or whether the dolly is retracted or not.

In many cases, constraints on the maximum DWOB, estimated by surface weight on bit (SWOB), limits the achievable rate of penetration (ROP). Based on studies comparing SWOB and DWOB obtained using an exemplary wired pipe, it is noted that SWOB differs from DWOB in lateral sections by a median of around 40%, with SWOB typically overestimating DWOB. This indicates that with a better estimate of DWOB, ROP could be increased. Much of the error in SWOB versus DWOB is represented by a constant value, as illustrated in FIG. 14.

Figure 14:
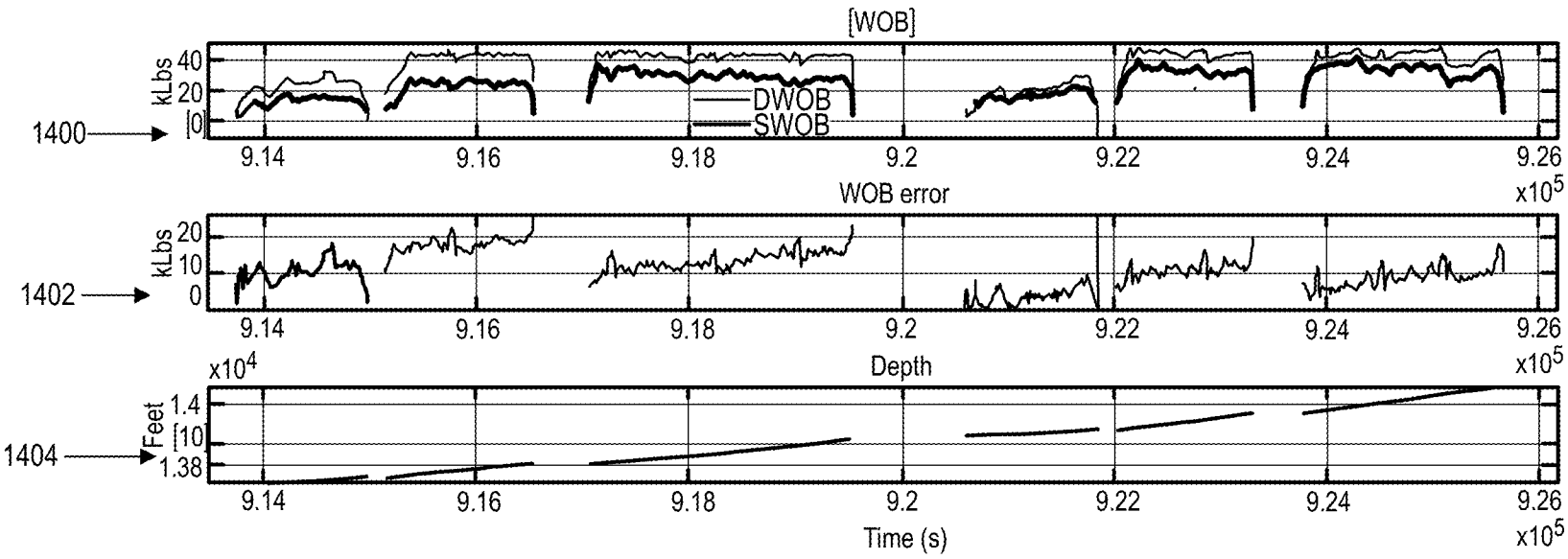
FIG. 14 illustrates six stands of drilling data including surface weight on bit (SWOB) from surface data and downhole weight on bit (DWOB) from downhole sensors, according to various embodiments.

FIG. 14 illustrates drilling data from six stands of drilling pipe including surface weight on bit (SWOB) from surface data and downhole weight on bit (DWOB) from downhole sensors, according to various embodiments. As shown in the first plot 1400, much of the dynamics in DWOB (illustrated in orange) are captured in the surface estimate (SWOB) (illustrated in blue, below the orange). The error (DWOB–SWOB) 1402 is largely flat for each stand. Although there is a slope 1404 in the error, much of the dynamics in DWOB are observed in the SWOB signal. The slope 1404 in the error is likely due to the variable load of the mud hose and electrical cables on the drawworks which changes with block position along the mast.

SWOB can be estimated while drilling by subtracting the hook load value at a given time from the hook load value determined just before drilling started, when the effect of DWOB on hook load is thought to be zero. This process is called zeroing and there is an analogous process for zeroing pressure while off bottom to compute differential pressure while drilling. A largely constant error in SWOB for each stand indicates that there is an opportunity to bring this error close to zero if an accurate hook load zero value and an accurate differential pressure zero value could be determined. Reducing error in SWOB and differential pressure would facilitate optimization of drilling set points and allow for a higher ROP.

The current process of zeroing hook load and differential pressure is largely manual and typically takes place during a window just before drilling begins, while the pipe is being lowered to the bottom of the hole. Capturing accurate zero values generally requires that systems, such as mud pumps and drawworks, reach steady state while off bottom. However, the time window appropriate for zeroing is often busy and chaotic. As a result, the system is often in a transient state inappropriate for accurate zeroing. Even in the best conditions, the zeroing process is subject to noise, dynamics in the system, and disturbances due to friction along the well bore. An automated process designed to reduce the effect of transients and noise is intended to improve zeroing.

There are two possible categories of methods for automated zeroing. The first category involves setting up the conditions smoothly and automating the process to capture values when the criteria for zeroing are satisfied. The second category involves the use of modeling and estimation to reduce the sensitivity to transients and disturbances and may include some components from the first category as well. In addition, recursive and sampling algorithms may be used to re-estimate zero values as drilling continues and additional data is obtained.

Category one may be a valid short-term solution. However, while methods from category one may be considered automatic, they do not address many of the challenges mentioned above. Sometimes automation requires a new approach rather than the simple addition of automatic triggers. For example, the common solution of automatic dishwashing looks much different than manual dishwashing.

Category two involves a reformulation of the problem and a different approach. Embodiments herein provide a system and method that mainly falls into category two. According to various embodiments, the system and method uses a drill string torque and drag model to reduce sensitivity to noise and disturbances. Friction coefficients are determined that can minimize the error between observations and model output. The model receives the history of measured hoisting hook load (HHL), lowering hook load (LHL), HHL and LHL while rotating, off-bottom torque (OBT), depth, and survey data for the current well as inputs to allow the model to learn the current conditions as drilling of the well progresses. The zero hook load for the next stand is output from the model. According to various embodiments, filters may be used to select the appropriate data to feed the model, such as by eliminating other data points from consideration. Estimating the best pressure offset may follow an analogous process.

A model like this may require more deliberate calibration at specific intervals. For example, in some embodiments, a procedure is run to hoist and lower the drill string with smooth conditions to capture the best data to feed the model. In other embodiments, the model confidence, or fit, is calculated to indicate when calibration is desired or required. In such embodiments, data may be captured using filters to select appropriate windows to record. But, if confidence falls below a predetermined threshold, calibration may be required and/or recommended, and may be performed automatically.

An analogous procedure may be used to compute a zero for pressure to estimate the load on a mud motor as a function of differential pressure. Instead of a torque and drag model, a fluid friction model may be used to estimate surface pressure. Well geometry and fluid density may be model inputs. Calibration may be done using surface pressure measured at the standpipe while off bottom and pumping at steady state. Fluid friction coefficients may be chosen to match estimated pressure to the measured calibration values. The fluid friction model would then output the zero pressure value as a function of the annular length while drilling.

According to various embodiments, data from downhole sensors are input to a torque and drag model. The torque and drag model described herein may be programmed as part of control system 168 or controller 1000 or may be a separate control system. The output of the torque and drag model can be used to determine relationships between drill string length and hoisting/lowering hook loads, and off bottom torque (drill string geometry, inclination, azimuth, and mud weights may also be required), and to generate model-based zero values. The model-based zero values may be compared to ideal zero values, i.e., the zero values that minimize error in SWOB relative to DWOB from downhole data sets, to establish the accuracy of the method. The torque/drag model may be applied to data for each well of interest at each depth for which data points are found. In some embodiments, hook load while drilling at different WOB magnitudes may be required.

It should be noted that models for torque and drag in connection with drilling operations have been studied and analyzed in the past. For example, the following materials describe models that address friction, torque and drag issues: SPE 151279 by Stephane Menand, "A New Buckling Severity Index to Quantify Failure and Lock-up Risks in Highly Deviated Wells" (2012), SPE/IADC-184657-MS by Eric Cayeux, Hans Joakim Skadsem, and Benoit Daireaux, "Challenges and Solutions to the Correct Interpretation of Drilling Friction Tests" (2017), SPE—191723—MS by Yang Zha, Stacey Ramsay, and Son Phan, "Real Time Surface Data Driven WOB Estimation and Control" (2018), and Christine Frafjord, "Friction Factor Model and Interpretation of Real Time Data," Norwegian University of Science and Technology (May 2013). Models describing pressure loss due to friction for drilling fluid have been described by: M E Ozbayoglu and M Sorgun "Frictional Pressure Loss Estimation of Non-Newtonian Fluids in Realistic Annulus with Pipe Rotation" (2009) 2009-042 Proceedings of the Canadian International Petroleum Conference and Arild Saasen, Jan David Ytrehus, and Bjornar Lund "Annular Frictional Pressure Losses for Drilling Fluids" (2021) 053201-1 Journal of Energy Technology Resources. Each of the foregoing materials is hereby incorporated by reference as if fully set forth herein.

Figure 15A:
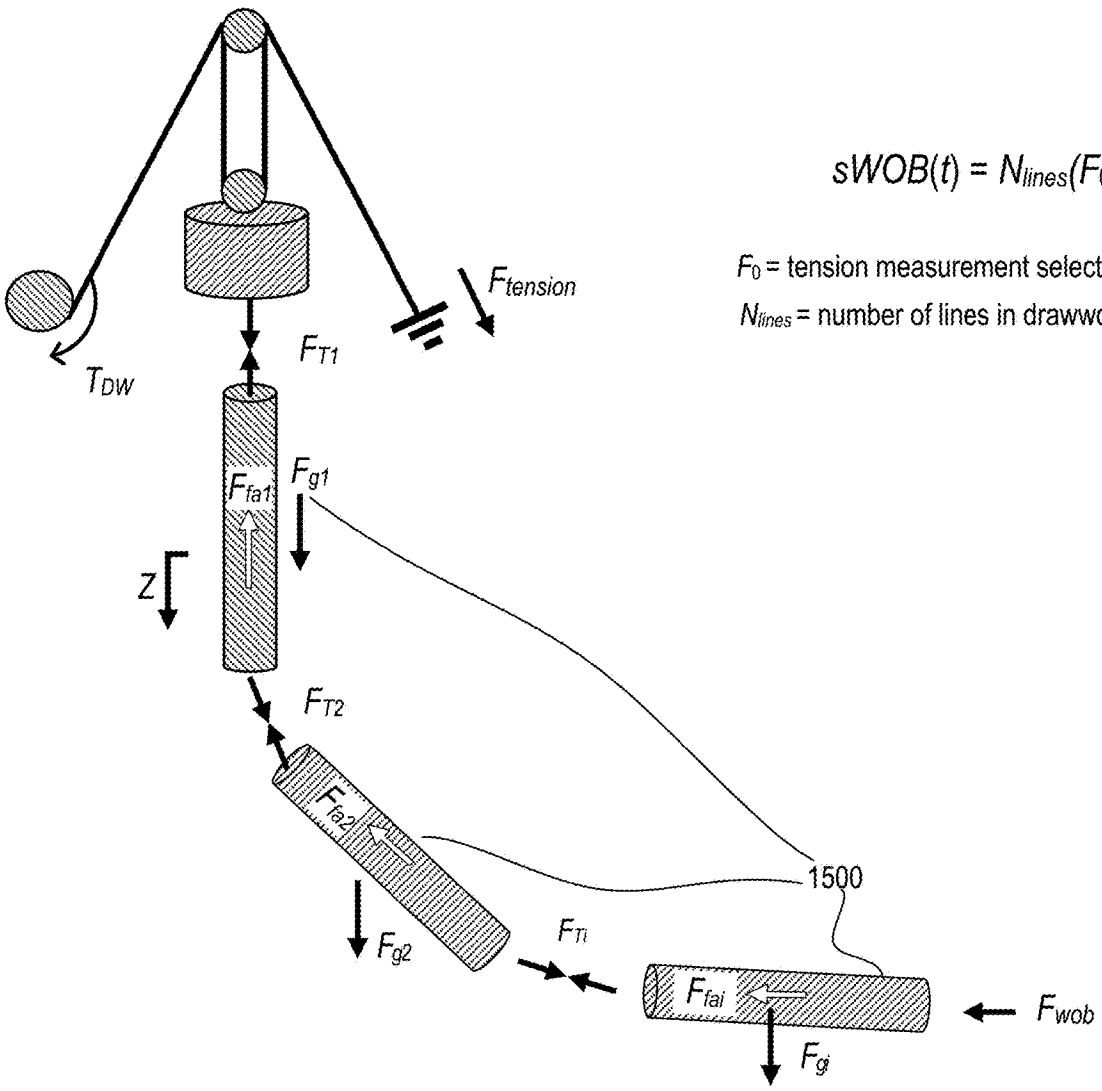
FIG. 15A illustrates a first exemplary well path, and an exemplary drill string in the well path, according to various embodiments.

FIG. 15A illustrates an exemplary drill string in the well path, according to various embodiments. When the well path, and the drill string in the well path are modeled as shown in FIG. 15A, the drill string can be divided into a plurality of discrete sections 1500. The weight of each of the sections 1500 can be determined with the effect of the mud and the wellbore friction on each section 1500.

Figure 15C:
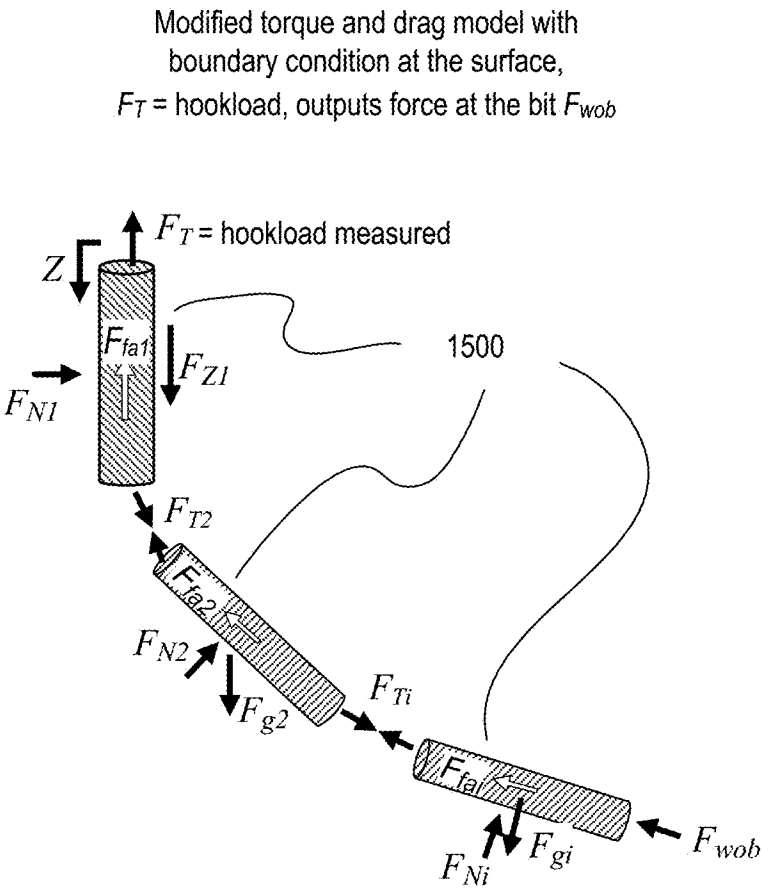
FIG. 15C illustrates a first exemplary well path, and an exemplary drill string in the well path, according to various embodiments.
Figure 15B:
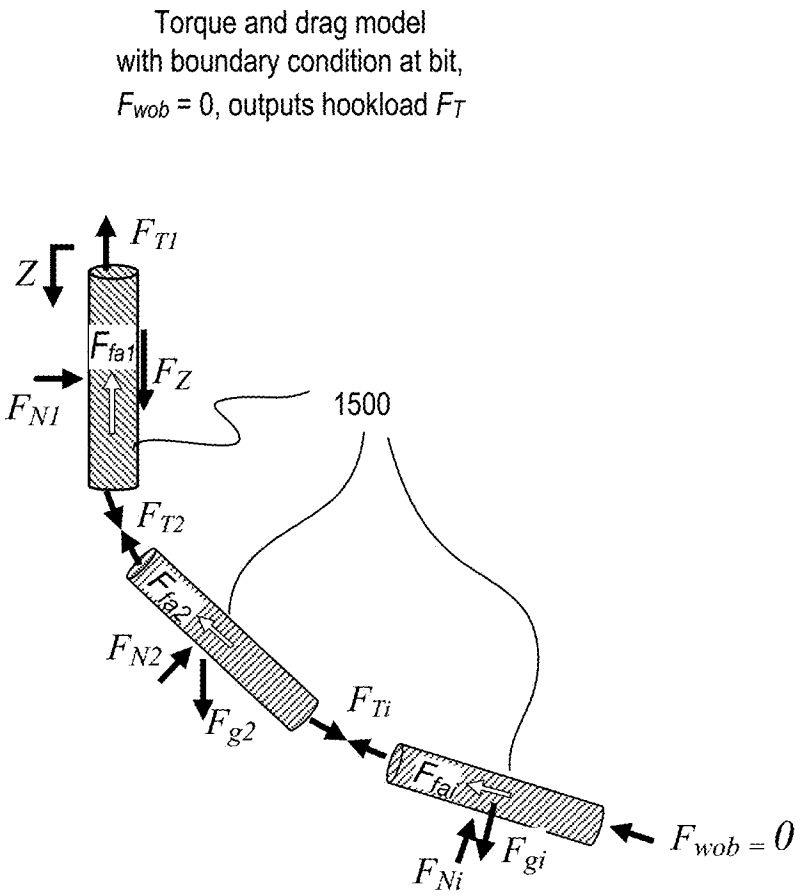
FIG. 15B illustrates a first exemplary well path, and an exemplary drill string in the well path, according to various embodiments.

Referring now to FIGS. 15A and 15B, two alternative torque and drag models that may be used are illustrated. In FIG. 15A, a torque and drag model is illustrated in which the force on the bit from the bottom of the wellbore is zero (such as when the drillstring is off bottom). In the approach shown in the model in FIG. 15B, the torque and drag model analyzes the forces shown on the segments 1500 of the drillstring and determines a hookload value Ft, which is then used to determine a weight on bit (WOB) value. As noted above, various torque and drag models exist which use this approach. In FIG. 15C, a modified approach to the torque and drag model is illustrated. In FIG. 15C, the hookload value (shown as feet (ft) on FIG. 15C) is taken as a boundary condition, and the torque and drag model uses the hookload value Ft to determine the force on the bit ($F_{wob}$ in FIG. 15C). It is believed that the modified approach illustrated in FIG. 15C may be used in situations to determine WOB without having to pause drilling operations to zero the drillstring, such as by lifting the drillstring off bottom. It should be further noted that the torque and drag model (either or both of the approaches shown in FIGS. 15B and 15C) may use a stiff-string model of the drillstring or may use a soft-string model of the drillstring in whole or for parts of the wellbore. For example, it is believed that the stiff-string model may be better (e.g., more accurate) when the wellbore segment 1500 (or entire wellbore) has a complex trajectory or when there is a high amount of compression of the drillstring (which may lead to buckling).

Figure 16:
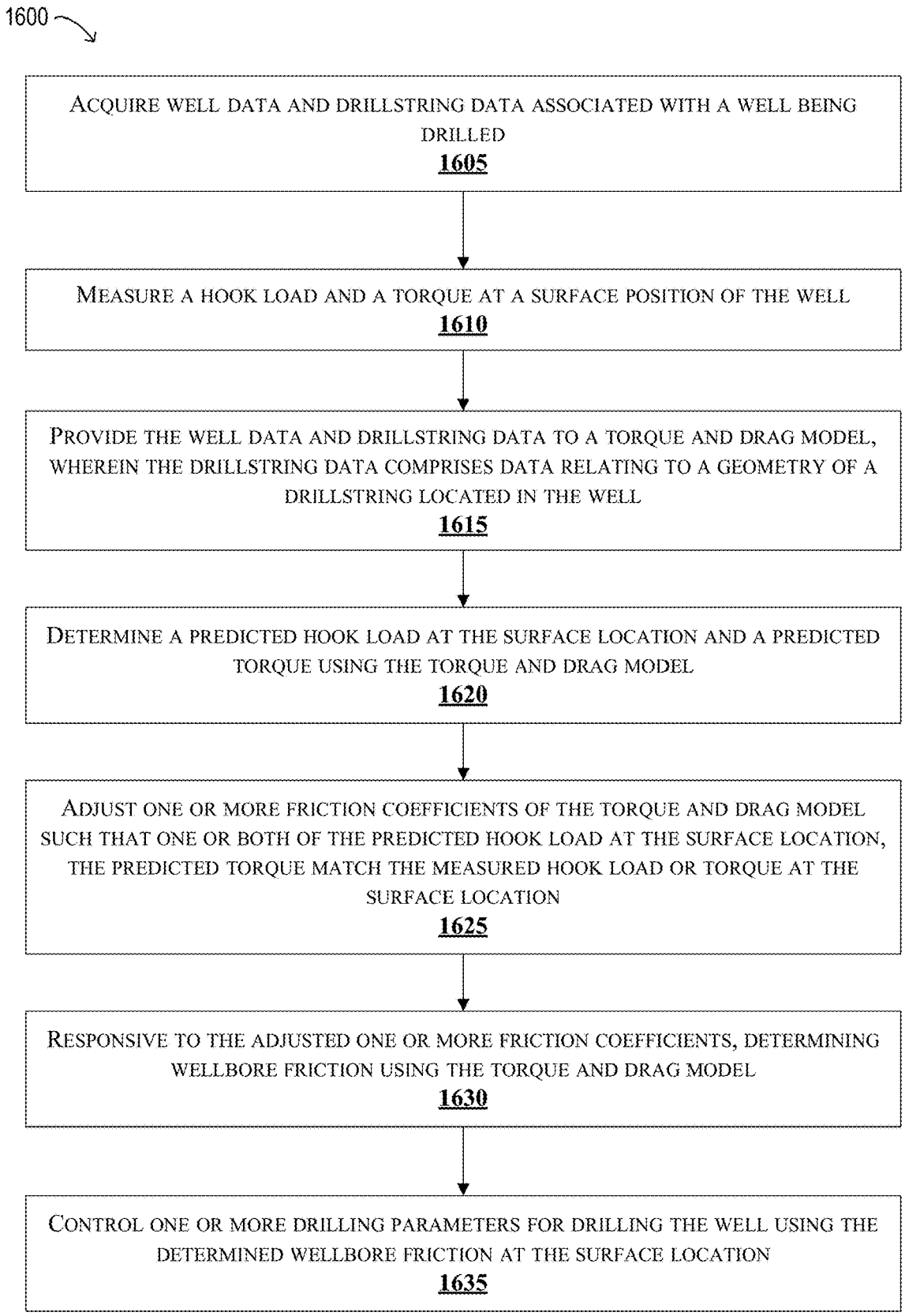
FIG. 16 is a flow chart of a process for determining a zero value for hook load of a drill string in a well, according to an example of the present disclosure.

FIG. 16 is a flow chart of a process 1600 for determining a zero value for hook load of a drill string in a well, according to an example of the present disclosure. According to an example, one or more process blocks of FIG. 16 can be performed by a computing device (e.g., controller 1000).

At block 1605, process 1600 can include acquiring well data and drillstring data associated with a well being drilled. The well data can include one or more of inclination, azimuth, and drilling mud weight. The drillstring data can include data relating to a geometry of a drillstring located in the well. For example, the computing device can acquire well data via one or more sensors associated with a wellbore or BHA associated with a well being drilled. Alternatively, or additionally, the well data can be stored in a memory in a server from previous or historical drilling events.

At block 1610, process 1600 can include measuring a hook load and a torque at a surface location. The hookload is the weight suspended in the derrick by the hoisting system of the rig. The hookload is the total force pulling down on the hook. The hook load is measured using weight indicators which could be placed at various locations on the drilling rig. At a plurality of successive depths of the drill string in the well, the load on the hook can be measured during free rotating, during pick up, and during running in. At each of these depths the free rotating torque is measured. This is the torque required to rotate the drilling string freely in the hole when it is not being moved up or down.

In various embodiments, measuring the hook load and the torque at the surface location further includes measuring and recording the hook load and torque at a steady state condition during one or more operations comprising one or more of hoisting or lowering, with a bit off bottom with or without rotating a pipe, and rotating the pipe while the bit is off bottom without moving a drawworks. These measurements can be digitized and applied as inputs to the digital computer. For example, one or more sensors can measure a hook load and a torque at a surface location, as described above.

At block 1615, process 1600 can include providing the well data and the drillstring data to a torque and drag model. In various embodiments, the well data can include a plurality of inclination, azimuth, drilling mud weight, and geometry of the well. The drillstring data can include data relating to a geometry of a drillstring located in the well. The well data and the drillstring data can be stored in a memory of a computing device or stored in a one or more data files on a server. For example, a computing system or a server may provide the well data and drillstring data via a network (e.g., the Internet) to a torque and drag model.

At block 1620, process 1600 can include determining a predicted hook load at the surface location and a predicted torque using the torque and drag model. In various embodiments, the well data (e.g., one or more of inclination, azimuth, and drilling mud weight) and the drillstring data (e.g., data relating to a geometry of a drillstring located in a well) can be inputs to the torque and drag model. The torque and drag model can be executed on the computing device. For example, the computing device can determine a predicted hook load at the surface location and a predicted torque using the torque and drag model, as described above.

In various embodiments, the predicted hook load or the predicted torque are determined to match the measured hook load or the predicted torque, respectively, when their values are within a predetermined range therefor.

At block 1625, process 1600 can include adjusting one or more friction coefficients of the torque and drag model such that one or both of the predicted hook load at the surface location and the predicted torque match the measured hook load or measured torque at the surface location. In various embodiments, the adjusting can be performed by a drilling operator. In various embodiments, the adjusting can be performed by a subroutine for a computing device. The subroutine can adjust (e.g., increase or decrease) a value of one or more friction coefficients used for the torque and drag model by a predetermined amount. The adjusted one or more friction coefficients can be stored in a memory of the computing device.

At block 1630, responsive to the adjusting one or more friction coefficients process 1600 may include determining wellbore friction using the torque and drag model. The adjusted one or more friction coefficients can be inputs the torque and drag model executed on the computing system. The computing system can calculate an estimate of wellbore friction. The calculated wellbore friction value may be stored in memory.

At block 1635, process 1600 can include controlling one or more drilling parameters for drilling the well using the determined wellbore friction at the surface location. For example, the calculated wellbore friction can be used to adjust one or more drilling parameters (e.g., weight on bit, differential pressure, rate of penetration, rate of rotation, etc.) during a drilling process to control the rate and trajectory of a bottom hole assembly during a drilling process.

It should be noted that while FIG. 16 shows example blocks of process 1600, in some implementations, process 1600 may include additional blocks, fewer blocks, different blocks, or differently arranged blocks than those depicted in FIG. 16. Additionally, or alternatively, two or more of the blocks of process 1600 may be performed in parallel.

In various embodiments, process 1600 can be performed automatically by a computer system that is coupled to one or more control systems of a drilling rig drilling the well.

In various aspects, a system is provided that includes one or more data processors and a memory coupled to the processor, the memory comprising instructions which, when executed on the one or more data processors, cause the one or more data processors to perform part or all of one or more of process 1600 as disclosed herein.

In various aspects, a computer-program product is provided that is tangibly embodied in a non-transitory machine-readable storage medium and that includes instructions configured to cause one or more data processors to perform part or all of one or more of process 1600 as disclosed herein.

It should be noted that while FIG. 16 shows example blocks of process 1600, in some implementations, process 1600 may include additional blocks, fewer blocks, different blocks, or differently arranged blocks than those depicted in FIG. 16. Additionally, or alternatively, two or more of the blocks of process 1600 may be performed in parallel.

Figure 17:
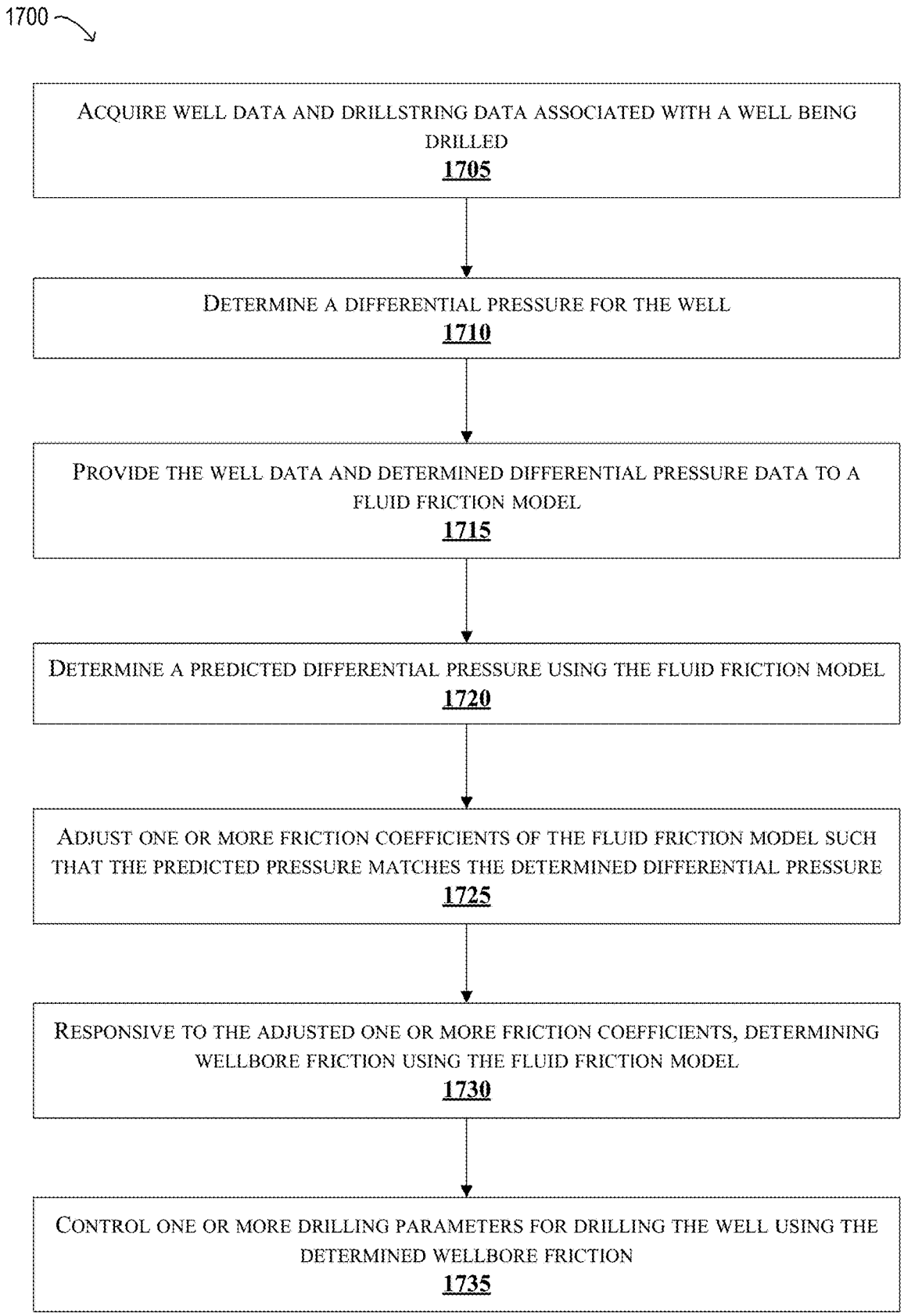
FIG. 17 is a flow chart of a process for determining a zero value for differential pressure in a well, according to an example of the present disclosure.

FIG. 17 is a flow chart of a process 1700 for determining a zero value for differential pressure in a well, according to an example of the present disclosure. According to an example, one or more process blocks of FIG. 17 can be performed by a computing device (e.g., controller 1000). In various embodiments, process 1700 can be performed automatically by a computer system that is coupled to one or more control systems of a drilling rig drilling the well.

At block 1705, process 1700 can include acquiring well data associated with a well being drilled. The well data can include one or more of fluid density, flow rate, and drill string geometry. For example, the computing device can acquire well data via one or more sensors associated with a wellbore or BHA associated with a well being drilled. Alternatively, or additionally, the well data can be stored in a memory in a server from previous or historical drilling events.

At block 1710, process 1700 can include determining a differential pressure for the well. In general, a measurement of fluid force per unit area (measured in units such as pounds per square inch) subtracted from a higher measurement of fluid force per unit area. This comparison could be made between pressures outside and inside a pipe, a pressure vessel, before and after an obstruction in a flow path, or simply between two points along any fluid path, such as two points along the inside of a pipe or across a packer. The differential pressure can be measured using differential pressure sensors.

At block 1715, process 1700 can include providing the well data and determined differential pressure data to a fluid friction model. In various embodiments, the well data may include a plurality of fluid density, flow rate, and drill string geometry. The well data and the determined differential pressure data can be stored in a memory of a computing device or stored in a one or more data files on a server. For example, a computing system or a server may provide the well data and differential pressure data via a network (e.g., the Internet) to a torque and drag model.

At block 1720, process 1700 can include determining a predicted differential pressure using the fluid friction model. In various embodiments, the well data (e.g., one or more of inclination, azimuth, and drilling mud weight) and the differential pressure data can be inputs to the fluid friction model. The fluid friction model can be executed on the computing device. For example, the computing device can determine a predicted value for the differential pressure using the fluid friction model, as described above.

At block 1725, process 1700 can include adjusting one or more friction coefficients of the fluid friction model such that the predicted pressure matches the determined differential pressure. In various embodiments, the adjusting can be performed by a drilling operator. In various embodiments, the adjusting can be performed by a subroutine for a computing device. The subroutine can adjust (e.g., increase or decrease) a value of one or more friction coefficients used for the fluid friction model by a predetermined amount. The adjusted one or more friction coefficients of the fluid friction model can be stored in a memory of the computing device.

At block 1730, responsive to the adjusting one or more friction coefficients, process 1700 can include determining wellbore friction using the fluid friction model. The adjusted one or more friction coefficients can be inputs the fluid friction model executed on the computing system. The computing system can calculate an estimate of wellbore friction. The calculated wellbore friction value may be stored in memory.

At block 1735, process 1700 can include controlling one or more drilling parameters for drilling the well using the determined wellbore friction. For example, the calculated wellbore friction can be used to adjust one or more drilling parameters (e.g., weight on bit, differential pressure, rate of penetration, rate of rotation, etc.) during a drilling process to control the rate and trajectory of a bottom hole assembly during a drilling process.

Process 1700 may include additional implementations, such as any single implementation or any combination of implementations described below and/or in connection with one or more other processes described elsewhere herein. In a first implementation, the method is performed automatically by a computer system that is coupled to one or more control systems of a drilling rig drilling the well.

In various embodiments, determining the differential pressure may include measuring and recording the differential pressure at a steady state condition during one or more operations may include one or more of hoisting or lowering, with a bit off bottom with or without rotating a pipe and rotating the pipe while the bit is off bottom without moving a drawworks.

In various embodiments, process 1700 may include detecting the steady state condition during drilling and, when the steady state condition is detected, capturing the steady state condition by at least one of one or more filters that monitor drilling operations for the steady state condition, a predetermined condition that is input by an operator, and an automated sequence programmed to capture data that can be used to calibrate a fluid friction model.

In various aspects, a system is provided that includes one or more data processors and a memory coupled to the processor, the memory comprising instructions which, when executed on the one or more data processors, cause the one or more data processors to perform part or all of one or more of process 1700 as disclosed herein.

In various aspects, a computer-program product is provided that is tangibly embodied in a non-transitory machine-readable storage medium and that includes instructions configured to cause one or more data processors to perform part or all of one or more of process 1700 as disclosed herein.

It should be noted that while FIG. 17 shows example blocks of process 1700, in some implementations, process 1700 may include additional blocks, fewer blocks, different blocks, or differently arranged blocks than those depicted in FIG. 17. Additionally, or alternatively, two or more of the blocks of process 1700 may be performed in parallel.

Figure 18:
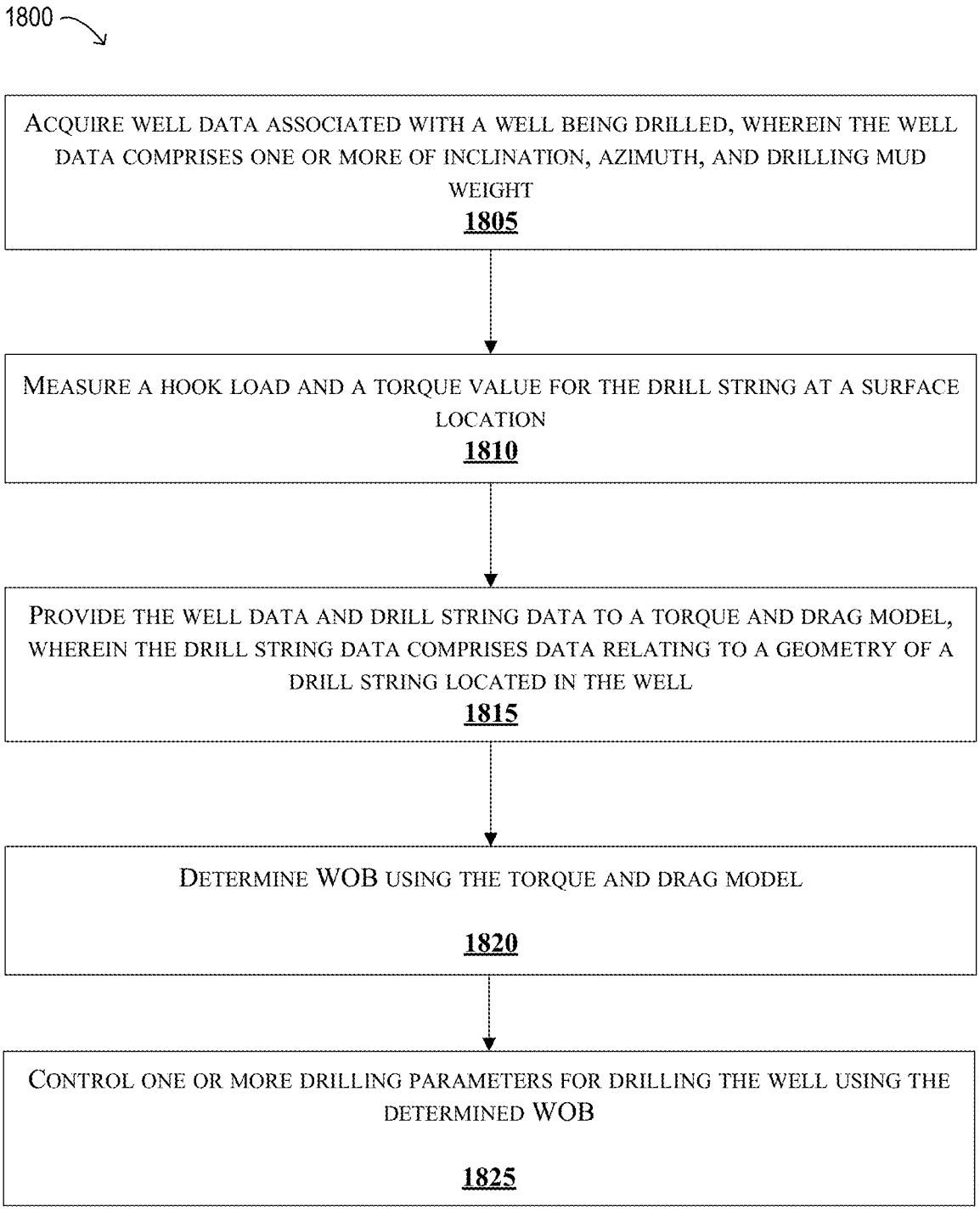
FIG. 18 is a flow chart of a process for determining a value for weight on bit (WOB) of a drill string in a well, according to an example of the present disclosure.

FIG. 18 is a flow chart of a process 1800 for determining a value for weight on bit (WOB) of a drill string in a well, according to an example of the present disclosure. According to an example, one or more process blocks of FIG. 18 can be performed by a computing device (e.g., controller 1000). In various embodiments, process 1800 can be performed automatically by a computer system that is coupled to one or more control systems of a drilling rig drilling the well.

At block 1805, process 1800 can include acquiring well data associated with a well being drilled. The well data comprises one or more of inclination, azimuth, and drilling mud weight. For example, the computing device can acquire well data via one or more sensors associated with a wellbore or BHA associated with a well being drilled. Alternatively, or additionally, the well data can be stored in a memory in a server from previous or historical drilling events.

At block 1810, process 1800 can include measuring a hook load and a torque value for the drill string at a surface position. The hook load can be measured using weight indicators which could be placed at various locations on the drilling rig. At a plurality of successive depths of the drill string in the well, the load on the hook can be measured during free rotating, during pick up, and during running in. At each of these depths the free rotating torque is measured. This is the torque required to rotate the drilling string freely in the hole when it is not being moved up or down.

In various embodiments, measuring the hook load and the torque at the surface location further includes measuring and recording the hook load and torque at a steady state condition during one or more operations comprising one or more of hoisting or lowering, with a bit off bottom with or without rotating a pipe, and rotating the pipe while the bit is off bottom without moving a drawworks. These measurements can be digitized and applied as inputs to the digital computer. For example, one or more sensors can measure a hook load and a torque at a surface location, as described above.

At block 1815, process 1800 can include providing the well data and drill string data to a torque and drag model, wherein the drill string data comprises data relating to a geometry of a drill string located in the well. In various embodiments, the well data can include a plurality of inclination, azimuth, drilling mud weight, and geometry of the well. The drillstring data can include data relating to a geometry of a drillstring located in the well. The well data and the drillstring data can be stored in a memory of a computing device or stored in a one or more data files on a server. For example, a computing system or a server may provide the well data and drillstring data via a network (e.g., the Internet) to a torque and drag model.

At block 1820, process 1800 can include determining WOB using the torque and drag model. The process 1800 can use one or more torque and drag models executed by one or more processors on one or more computing systems to determine WOB for drilling operations.

At block 1825, process 1800 can include controlling one or more drilling parameters for drilling the well using the determined WOB. For example, the calculated WOB can be used to adjust one or more other drilling parameters (e.g., differential pressure, rate of penetration, rate of rotation, etc.) during a drilling process to control the rate and trajectory of a bottom hole assembly during a drilling process.

Process 1800 may include additional implementations, such as any single implementation or any combination of implementations described below and/or in connection with one or more other processes described elsewhere herein.

In various embodiments, process 1800 may include detecting the steady state condition during drilling and, when the steady state condition is detected, capturing the steady state condition by at least one of one or more filters that monitor drilling operations for the steady state condition, a predetermined condition that is input by an operator, and an automated sequence programmed to capture data that can be used to calibrate a fluid friction model.

In various aspects, a system is provided that includes one or more data processors and a memory coupled to the processor, the memory comprising instructions which, when executed on the one or more data processors, cause the one or more data processors to perform part or all of one or more of process 1800 as disclosed herein.

In various aspects, a computer-program product is provided that is tangibly embodied in a non-transitory machine-readable storage medium and that includes instructions configured to cause one or more data processors to perform part or all of one or more of process 1700 as disclosed herein.

It should be noted that while FIG. 18 shows example blocks of process 1800, in some implementations, process 1800 may include additional blocks, fewer blocks, different blocks, or differently arranged blocks than those depicted in FIG. 18. Additionally, or alternatively, two or more of the blocks of process 1800 may be performed in parallel.

As noted, one or more computer control systems may be programmed to implement one or more of the embodiments as disclosed herein. Moreover, the one or more control systems may be the steering control system 168 or the controller 1000 as described above and may be coupled to any one or more of the drilling rig 210 control systems, such as those illustrated in FIG. 5. The information obtained by the systems and methods of the present disclosure may, for example, be used to control, modify, or maintain drilling parameters as automatically determined by the control system(s), and to drill the well accordingly.

Figure 19:
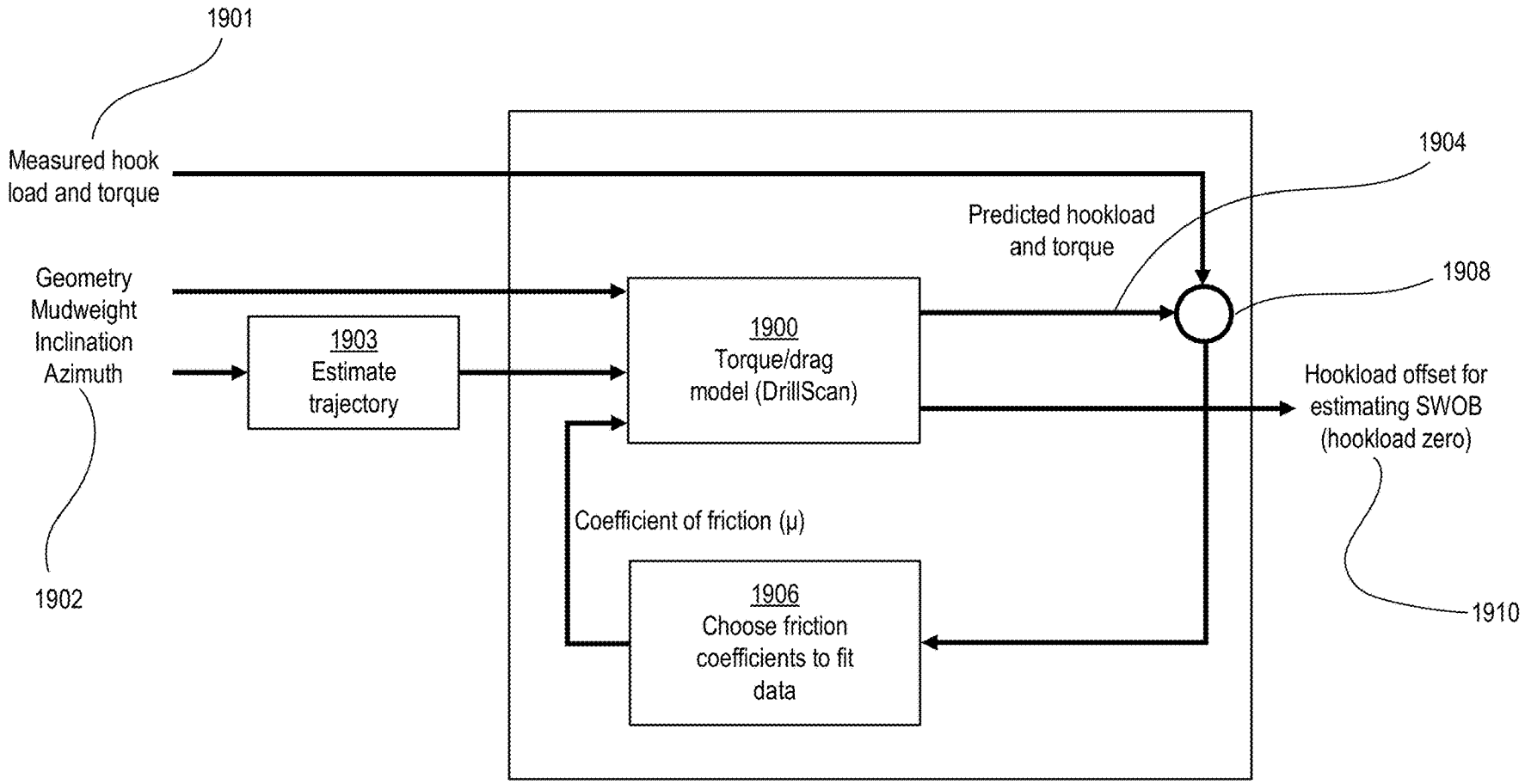
FIG. 19 illustrates an exemplary block diagram for estimating surface weight on bit (e.g., the hook load zero), according to various embodiments.

FIG. 19 illustrates an exemplary block diagram for estimating surface weight on bit (SWOB) (e.g., the hook load zero), according to various embodiments. As shown in FIG. 19, an exemplary torque-and-drag model 1900 may be used to estimate wellbore friction. The inputs 1902 to the torque-and-drag model 1900 include the inclination and azimuth of the BHA, the drill string geometry, and the mud weight. Using this information, the control system can estimate the trajectory of the wellbore such as by a separate software module 1903. This information 1902, 1903 (e.g., inclination, azimuth, geometry, mud weight, and wellbore trajectory) can be provided as inputs to the torque and drag model 1900. The model 1900 provides an output of the predicted hook load and torque values at 1904. The output predicted values 1904 can then be combined with friction coefficients 1906 and then provided as further inputs to the torque and drag model 1900. The control system can thus apply a plurality of different friction coefficients to the predicted values through an iterative process until the predicted values 1904 match the observed values 1901 (or are within a specified range of the observed values). For example, the control system may be programmed to apply the most recently observed friction coefficients, and then compare the predicted values 1904 to measured values 1901 and determine the difference, then increment or decrement the friction coefficients 1906 by a predetermined amount (which in some embodiments may be pre-programmed and in others may be input by an operator) and then recalculate the predicted values and compare them to the measured values. This process may be repeated until a match is determined. In some embodiments, a match may be determined by having the predicted and measured values 1904, 1901 within a set range of one another, as opposed to being identical or essentially identical values. In another embodiment, it may be possible to select or use friction coefficients 1906 based on a friction profile determined through "depth sounding" methods and techniques, such as those described in co-pending U.S. patent application Ser. No. 17/340,457, filed on Jun. 7, 2021, and entitled "Wellbore Friction Depth Sounding by Oscillating a Drill String or Casing," which is hereby incorporated by reference as if fully set forth herein.

The output 1904 of the torque-and-drag model 1900 may include a predicted hook load at the surface and a predicted torque. According to various embodiments, the hook loads and torques for each section 1900 may be calculated while the drill string is lowered at a constant speed with and without rotating, the drill string is raised at a constant speed with and without rotating, and the top drive is rotated. The wellbore friction can be determined by adjusting the friction factors and/or the friction coefficients 1906 in the torque-and-drag model 1900, which can be done for a number of different friction coefficients in an iterative process, so that the predicted hook load and torque 1904 at the surface matches the measured hook load and torque 1901 at the surface.

Embodiments provide model-based zeroing to be able to take into consideration multiple variables and/or parameters of a particular well, thereby being able to determine an ideal zero at different conditions (e.g., a first ideal zero with zero weight on bit would be different than a second ideal zero with some amount of weight on bit).

Figure 20:
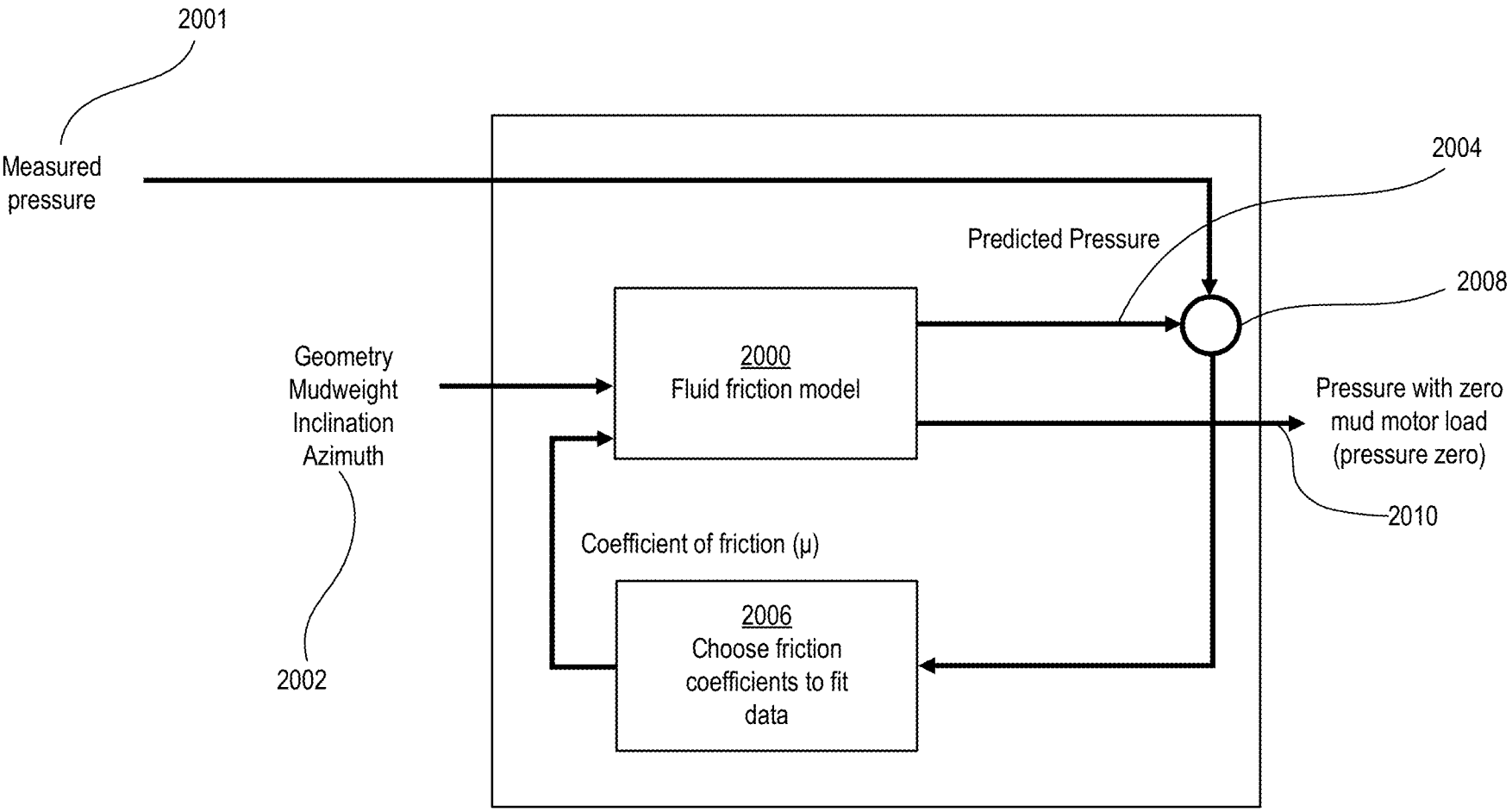
FIG. 20 illustrates an exemplary block diagram for estimating surface pressure with zero mud motor load, according to various embodiments.

As noted above, it may be useful to determine the zero value for differential pressure for use in drilling operations. Referring now to FIG. 20, a schematic of a control system for zeroing differential pressure (i.e., determining the conditions for a zero differential pressure across the mud motor) is provided. As illustrated in FIG. 20, inputs 2002 may include fluid density, flow rate, and the geometry of the drill string pipe and/or well. These inputs 2002 are provided to a fluid friction model 2000. The model 2000 uses the inputs 2002 to determine a predicted differential pressure 2004. The predicted differential pressure 2004 can be compared at 2008 with a measured differential pressure 2001. When the predicted and measured differential pressures 2004, 2001 match (e.g., are within a certain threshold value or target range of one another), the model 2000 has used appropriate friction coefficients, and the model 2000 can predict the zero differential pressure conditions based on such friction coefficients. If the predicted and measured differential pressures 2004 and 2001 do not match (or do not match adequately per a predetermined threshold or target value for determining a match), then alternative friction coefficients may be applied to the predict pressure and applied with the fluid friction model system 2000. This process may be repeated in an iterative fashion with different friction coefficients being applied until a match is determined between the predicted and measured differential pressures 2004, 2001. The friction coefficients applied may be determined by input from an operator, may be determined by incrementing or decrementing by a set amount from the prior friction coefficients applied, or may be determined at least in part responsive to the difference between the predicted and measured differential pressures 2004, 2001, using an automated optimization algorithm. For example, if the difference is relatively large, a larger increment or decrement may be appropriate than a smaller increment or decrement. The determination of whether to increment or decrement can be responsive to whether a predicted value is larger or smaller than a measured value, for example, or the system could be programmed by looking at whether the measured value is larger or smaller than the predicted value.

As used below, any reference to a series of examples is to be understood as a reference to each of those examples disjunctively (e.g., "Examples 1-4" is to be understood as "Examples 1, 2, 3, or 4").

Example 1 is a method for determining a zero value for hook load of a drill string in a well, the method comprising: acquiring well data and drillstring data associated with a well being drilled, wherein the well data comprises one or more of inclination, azimuth, and drilling mud weight; measuring a hook load and a torque at a surface location; providing the well data and the drillstring data to a torque and drag model, wherein the drillstring data comprises data relating to a geometry of a drillstring located in the well; determining a predicted hook load at the surface location and a predicted torque using the torque and drag model; adjusting one or more friction coefficients of the torque and drag model such that one or both of the predicted hook load at the surface location, the predicted torque match the measured hook load or torque at the surface location; responsive to the adjusting one or more friction coefficients, determining wellbore friction using the torque and drag model; and controlling one or more drilling parameters for drilling the well using the determined wellbore friction at the surface location.

Example 2 is the method according to claim 1, wherein the method is performed automatically by a computer system that is coupled to one or more control systems of a drilling rig drilling the well.

Example 3 is the method according to claim 1, wherein the well data comprises a plurality of inclination, azimuth, drilling mud weight, and geometry of the well.

Example 4 is the method according to claim 1, wherein measuring the hook load and the torque at the surface location further comprises measuring and recording the hook load and torque at a steady state condition during one or more operations comprising one or more of hoisting or lowering, with a bit off bottom with or without rotating a pipe and rotating the pipe while the bit is off bottom without moving a drawworks.

Example 5 is the method according to claim 4, further comprising detecting the steady state condition during drilling and, when the steady state condition is detected, capturing the steady state condition by at least one of one or more filters that monitor drilling operations for the steady state condition, a predetermined condition that is input by an operator, and an automated sequence programmed to capture data that can be used to calibrate the torque and drag model.

Example 6 is the method according to claim 1, wherein the predicted hook load or the predicted torque are determined to match the measured hook load or the predicted torque, respectively, when their values are within a predetermined range therefor.

Example 7 is a system for zeroing weight on bit (WOB) of a drill string for a well being drilled, the system comprising: a processor; a memory coupled to the processor, the memory comprising instructions for: receiving downhole information from one or more sensors; estimating a trajectory of a wellbore of a well being drilled; providing the downhole information and the estimated trajectory of the wellbore to a torque and drag model; obtaining a predicted hook load or torque value from the model; applying a plurality of coefficient of friction values to the predicted hook load or torque value; determining which one of the plurality of the coefficient of friction values provides a match of the predicted hook load or torque value with a measured hook load or torque value, respectively; providing the one of the plurality of the coefficient of friction values to the torque and drag model to obtain an updated predicted value of hook load or torque; and using the updated predicted value of hook load or torque to compute a zero value for hook load used for estimating WOB.

Example 8 is the system according to claim 7, wherein the system uses both hook load and torque predicted, measured, and updated predicted values.

Example 9 is the system according to claim 7, wherein the system uses both predicted values and measured values for hook load.

Example 10 is the system according to claim 7, wherein the system uses both predicted values and measured values for torque.

Example 11 is the system according to claim 7, wherein the torque and drag model comprises a finite element model.

Example 12 is the system according to claim 7, wherein a match is determined by a least squares regression.

Example 13 is the system according to claim 7, wherein a match is determined when a difference between a predicted value for hook load and a measured value for hook load, falls within a predetermined range therefor or does not exceed a threshold therefor.

Example 14 is the system according to claim 7, wherein a match is determined when a difference between a predicted torque and a measured value for torque, falls within a predetermined range therefor or does not exceed a threshold therefor.

Example 15 is a non-transitory computer-readable medium storing a plurality of instructions executable by one or more processors that cause the one or more processors to perform operations comprising: acquiring well data associated with a well being drilled, wherein the well data comprises one or more of inclination, azimuth, and drilling mud weight; measuring a hook load and a torque at a surface location; providing the well data and drillstring data to a torque and drag model, wherein the drillstring data comprises data relating to a geometry of a drillstring located in the well; determining a predicted hook load at the surface location and a predicted torque using the torque and drag model; adjusting one or more friction coefficients of the torque and drag model such that one or both of the predicted hook load at the surface location, the predicted torque matches the measured hook load or torque at the surface location; responsive to the adjusting one or more friction coefficients, determining wellbore friction using the torque and drag model; and controlling one or more drilling parameters for drilling the well using the determined wellbore friction at the surface location.

Example 16 is the non-transitory computer-readable medium of example(s) 15, wherein the operations are performed automatically by a computer system that is coupled to one or more control systems of a drilling rig drilling the well.

Example 17 is the non-transitory computer-readable medium of example(s) 15, wherein the well data comprises a plurality of inclination, azimuth, drilling mud weight, and geometry of the well.

Example 18 is the non-transitory computer-readable medium of example(s) 15, wherein measuring the hook load and the torque at the surface location further comprises measuring and recording the hook load and torque at a steady state condition during one or more operations comprising one or more of hoisting or lowering, with a bit off bottom with or without rotating a pipe and rotating the pipe while the bit is off bottom without moving a drawworks.

Example 19 is the non-transitory computer-readable medium of example(s) 18, wherein the operations further comprise detecting the steady state condition during drilling and, when the steady state condition is detected, capturing the steady state condition by at least one of one or more filters that monitor drilling operations for the steady state condition, a predetermined condition that is input by an operator, and an automated sequence programmed to capture data that can be used to calibrate the torque and drag model.

Example 20 is the non-transitory computer-readable medium of example(s) 15, wherein the predicted hook load or the predicted torque are determined to match the measured hook load or the predicted torque, respectively, when their values are within a predetermined range therefor.

Example 21 is a method for determining a zero value for differential pressure in a well, the method comprising: acquiring well data associated with a well being drilled, wherein the well data comprises one or more of fluid density, flow rate, and drill string geometry; determining a differential pressure for the well; providing the well data and determined differential pressure data to a fluid friction model; determining a predicted differential pressure using the fluid friction model; adjusting one or more friction coefficients of the fluid friction model such that the predicted pressure matches the determined differential pressure; responsive to the adjusting one or more friction coefficients, determining wellbore friction using the fluid friction model; and controlling one or more drilling parameters for drilling the well using the determined wellbore friction.

Example 22 is the method according to claim 21, wherein the method is performed automatically by a computer system that is coupled to one or more control systems of a drilling rig drilling the well.

Example 23 is the method according to claim 21, wherein the well data comprises a plurality of fluid density, flow rate, and drill string geometry.

Example 24 is the method according to claim 21, wherein determining the differential pressure comprises measuring and recording the differential pressure at a steady state condition during one or more operations comprising one or more of hoisting or lowering, with a bit off bottom with or without rotating a pipe and rotating the pipe while the bit is off bottom without moving a drawworks.

Example 25 is the method according to claim 24, further comprising detecting the steady state condition during drilling and, when the steady state condition is detected, capturing the steady state condition by at least one of one or more filters that monitor drilling operations for the steady state condition, a predetermined condition that is input by an operator, and an automated sequence programmed to capture data that can be used to calibrate a fluid friction model.

Example 26 is the method according to claim 24, wherein the predicted pressure is determined to match a measured differential pressure when their values are within a predetermined range therefor.

Example 27 is a system for zeroing differential pressure for a well being drilled, the system comprising: a processor; a memory coupled to the processor, the memory comprising instructions for: receiving downhole information from one or more sensors; estimating a trajectory of a wellbore of a well being drilled; providing the downhole information and the estimated trajectory of the wellbore to a fluid friction model; obtaining a predicted differential pressure value from the fluid friction model; applying a plurality of coefficients of fluid friction values to the fluid friction model; determining which one of the plurality of the coefficient of friction values provides a match of the predicted differential pressure value with a measured pressure value; providing the one of the plurality of the coefficient of friction values to the fluid friction model to obtain an updated predicted value of differential pressure; and using the updated predicted value of differential pressure to compute a zero value for differential pressure used for estimating zero load pressure.

Example 28 is the system according to claim 27, wherein the fluid friction model comprises a finite element model.

Example 29 is the system according to claim 27, wherein a match is determined by a least squares regression.

Example 30 is the system according to claim 27, wherein a match is determined when a difference between a predicted value for differential pressure and a measured value differential pressure, falls within a predetermined range therefor or does not exceed a threshold therefor.

Example 31 is a non-transitory computer-readable medium storing a plurality of instructions executable by one or more processors that cause the one or more processors to perform operations comprising: receiving downhole information from one or more sensors; estimating a trajectory of a wellbore of a well being drilled; providing the downhole information and the estimated trajectory of the wellbore to a fluid friction model; obtaining a predicted differential pressure value from the fluid friction model; applying a plurality of coefficients of fluid friction values to the fluid friction model; determining which one of the plurality of the coefficient of friction values provides a match of the predicted differential pressure value with a measured pressure value; providing the one of the plurality of the coefficient of friction values to the fluid friction model to obtain an updated predicted value of differential pressure; and using the updated predicted value of differential pressure to compute a zero value for differential pressure used for estimating zero load pressure.

Example 32 is the non-transitory computer-readable medium of example(s) 31, wherein the fluid friction model comprises a finite element model.

Example 33 is the non-transitory computer-readable medium of example(s) 31, wherein a match is determined by a least squares regression.

Example 34 is the non-transitory computer-readable medium of example(s) 31, wherein a match is determined when a difference between a predicted value for differential pressure and a measured value differential pressure, falls within a predetermined range therefor or does not exceed a threshold therefor.

Example 35 is a method for determining a value for weight on bit (WOB) of a drill string in a well, the method comprising: acquiring well data associated with a well being drilled, wherein the well data comprises one or more of inclination, azimuth, and drilling mud weight; measuring a hook load and a torque value for the drill string at a surface position; providing the well data and drill string data to a torque and drag model, wherein the drill string data comprises data relating to a geometry of a drill string located in the well; and determining WOB using the torque and drag model.

Example 36 is the method according to claim 35, wherein the method is performed automatically by a computer system that is coupled to one or more control systems of a drilling rig drilling the well.

Example 37 is the method according to claim 35, wherein the well data comprises a plurality of inclination, azimuth, drilling mud weight, and geometry of the well.

Example 38 is the method according to claim 35, wherein measuring the hook load and the torque at the surface location further comprises measuring and recording the hook load and torque at a steady state condition during one or more operations comprising one or more of hoisting or lowering, with a bit off bottom with or without rotating a pipe, and rotating the pipe while the bit is off bottom without moving a drawworks.

Example 39 is the method according to claim 38, wherein measuring the hook load and the torque at the surface location is performed with a bit on bottom and wherein a force is applied to the bit by a formation.

Example 40 is the method according to claim 38, further comprising detecting the steady state condition during drilling and, when the steady state condition is detected, capturing the steady state condition by at least one of one or more filters that monitor drilling operations for the steady state condition, a predetermined condition that is input by an operator, and an automated sequence programmed to capture data that can be used to calibrate the torque and drag model.

Example 41 is the method according to claim 35, further comprising: adjusting one or more friction coefficients of the torque and drag model responsive to the measured hook load and a determined force on a bit; responsive to the adjusting one or more friction coefficients, determining wellbore friction using the torque and drag model; and controlling one or more drilling parameters for drilling the well using the determined wellbore friction.

Example 42 is a system for determining weight on bit (WOB) of a drill string for a well being drilled, the system comprising: a processor; a memory coupled to the processor, the memory comprising instructions for: receiving downhole information from one or more sensors; estimating a trajectory of a wellbore of a well being drilled; providing the downhole information and the estimated trajectory of the wellbore to a torque and drag model; measuring a hook load value; applying a plurality of coefficient of friction values to the measured hook load; determining which one of the plurality of the coefficient of friction values provides a solution by the torque and drag model for the hook load value and a force applied to a bit; providing the one of the plurality of the coefficient of friction values to the torque and drag model to obtain an updated predicted value of WOB; and using the updated predicted value of WOB for adjusting one or more drilling parameters.

Example 43 is the system according to claim 42, wherein the system uses both hook load and torque predicted, measured, and updated predicted values.

Example 44 is the system according to claim 43, wherein the torque and drag model comprises a finite element model.

Example 45 is the system according to claim 42, wherein a match is determined by a least squares regression.

Example 46 is the system according to claim 42, wherein the hook load value is measured while the bit is on bottom.

Example 47 is a non-transitory computer-readable medium storing a plurality of instructions executable by one or more processors that cause the one or more processors to perform operations comprising: acquiring well data associated with a well being drilled, wherein the well data comprises one or more of inclination, azimuth, and drilling mud weight. The operations can include measuring a hook load and a torque value for a drillstring at a surface position; providing the well data and drill string data to a torque and drag model, wherein the drill string data comprises data relating to a geometry of a drill string located in the well; and determining WOB using the torque and drag model.

Example 48 is the non-transitory computer-readable medium of example(s) 47, wherein the operations are performed automatically by a computer system that is coupled to one or more control systems of a drilling rig drilling the well.

Example 49 is the non-transitory computer-readable medium of example(s) 47, wherein the well data comprises a plurality of inclination, azimuth, drilling mud weight, and geometry of the well.

Example 50 is the non-transitory computer-readable medium of example(s) 47, wherein measuring the hook load and the torque at the surface location further comprises measuring and recording the hook load and torque at a steady state condition during one or more operations comprising one or more of hoisting or lowering, with a bit off bottom with or without rotating a pipe, and rotating the pipe while a bit is off bottom without moving a drawworks.

Example 51 is the non-transitory computer-readable medium of example(s) 50, wherein measuring the hook load and the torque at the surface location is performed with a bit on bottom and wherein a force is applied to the bit by a formation.

Example 52 is the non-transitory computer-readable medium of example(s) 50, further comprising detecting the steady state condition during drilling and, when the steady state condition is detected, capturing the steady state condition by at least one of one or more filters that monitor drilling operations for the steady state condition, a predetermined condition that is input by an operator, and an automated sequence programmed to capture data that can be used to calibrate the torque and drag model.

Example 53 is the non-transitory computer-readable medium of example(s) 47, further comprising: adjusting one or more friction coefficients of the torque and drag model responsive to the measured hook load and the determined force on a bit; responsive to the adjusting one or more friction coefficients, determining wellbore friction using the torque and drag model; and controlling one or more drilling parameters for drilling the well using the determined wellbore friction.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents and shall not be restricted or limited by the foregoing detailed description.

What is claimed is:

1. A system for drilling, comprising:

a processor;

a memory coupled to the processor, the memory comprising instructions for:

measuring a hook load and a torque at a surface location;

measuring a differential pressure;

receiving downhole information from one or more sensors;

estimating a trajectory of a wellbore of a well being drilled;

obtaining a predicted hook load or a predicted torque value from a torque and drag model using the downhole information, the estimated trajectory of the wellbore, and a first coefficient of friction value;

adjusting the first coefficient of friction value to cause one or both of the predicted hook load and the predicted torque to match the measured hook load or torque at the surface location;

providing the adjusted first coefficient of friction value to the torque and drag model to obtain an updated predicted value of hook load or torque;

obtaining a predicted differential pressure value from a fluid friction model using the downhole information, and a second coefficient of friction value;

adjusting the second coefficient of friction value to cause the predicted differential pressure to match the measured differential pressure;

providing the adjusted second coefficient of friction value to the fluid friction model to obtain an updated predicted value of differential pressure;

using the updated predicted value of hook load or torque to compute a first zero value for hook load used for estimating WOB;

using the updated predicted value of differential pressure to compute a second zero value for differential pressure; and sending one or more control signals to a rig controller to adjust a drilling parameter based on at least one of the first zero value for hook load or the second zero value for differential pressure.

2. The system according to claim 1, wherein the system uses both hook load and torque predicted, measured, and updated predicted values.

3. The system according to claim 1, wherein the system uses both predicted values and measured values for hook load.

4. The system according to claim 1, wherein the system uses both predicted values and measured values for torque.

5. The system according to claim 1, wherein the torque and drag model comprises a finite element model.

6. The system according to claim 1, wherein a match is determined by a least squares regression.

7. The system according to claim 1, wherein a match is determined when a difference between a predicted value for hook load and a measured value for hook load falls within a predetermined range therefor or does not exceed a threshold therefor.

8. The system according to claim 1, wherein a match is determined when a difference between a predicted torque and a measured value for torque, falls within a predetermined range therefor or does not exceed a threshold therefor.

9. A method performed by a computer system comprising:

acquiring well data associated with a well being drilled, wherein the well data comprises one or more of inclination, azimuth, or drilling mud weight;

measuring a hook load and a torque at a surface location;

measuring a differential pressure;

receiving downhole information;

estimating a trajectory of a wellbore of the well being drilled;

obtaining a predicted hook load or a predicted torque value from a torque and drag model using the well data, the estimated trajectory of the wellbore, and a first coefficient of friction value;

adjusting the first coefficient of friction value to cause one or both of the predicted hook load and the predicted torque to match the measured hook load or torque at the surface location;

providing the adjusted first coefficient of friction value to the torque and drag model to obtain an updated predicted value of hook load or torque;

obtaining a predicted differential pressure value from a fluid friction model using the downhole information, and a second coefficient of friction value;

adjusting the second coefficient of friction value to cause the predicted differential pressure to match the measured differential pressure;

providing the adjusted second coefficient of friction value to the fluid friction model to obtain an updated predicted value of differential pressure;

using the first coefficient of friction to determine wellbore friction using the torque and drag model;

using the updated predicted value of differential pressure to compute a zero value for differential pressure; and controlling one or more drilling parameters for drilling the well using at least one of the determined wellbore friction at the surface location or the zero value for differential pressure.

10. The method according to claim 9, wherein the computer system is communicatively coupled to one or more control systems of a drilling rig drilling the well; and wherein adjusting the first coefficient of friction input to the torque and drag model comprises adjusting one or more previous friction coefficients that were previously generated using output from the torque and drag model.

11. The method according to claim 9, wherein the well data comprises a plurality of inclination, an azimuth, a drilling mud weight, and a geometry of the well.

12. The method according to claim 9, wherein measuring the hook load and the torque at the surface location further comprises measuring and recording the hook load and torque at a steady state condition during one or more operations comprising one or more of hoisting or lowering, with a bit off bottom with or without rotating a pipe, and rotating the pipe while the bit is off bottom without moving a drawworks.

13. The method according to claim 12, further comprising detecting the steady state condition during drilling and, when the steady state condition is detected, capturing the steady state condition by at least one of one or more filters that monitor drilling operations for the steady state condition, a predetermined condition that is input by an operator, and an automated sequence programmed to capture data that can be used to calibrate the torque and drag model.

14. The method according to claim 9, wherein the predicted hook load or the predicted torque are determined to match the measured hook load or the predicted torque, respectively, when their values are within a predetermined range therefor.

15. A non-transitory computer-readable medium storing a plurality of instructions executable by one or more processors that cause the one or more processors to perform operations comprising:

acquiring well data associated with a well being drilled, wherein the well data comprises one or more of inclination, azimuth, and drilling mud weight;

measuring a hook load and a torque at a surface location;

measuring a differential pressure;

receiving downhole information;

estimating a trajectory of a wellbore of the well being drilled;

obtaining a predicted hook load or a predicted torque value from a torque and drag model using the well data, the estimated trajectory of the wellbore, and a first coefficient of friction value;

adjusting the first coefficient of friction value to cause one or both of the predicted hook load and the predicted torque to match the measured hook load or torque at the surface location;

providing the adjusted first coefficient of friction value to the torque and drag model to obtain an updated predicted value of hook load or torque obtaining a predicted differential pressure value from a fluid friction model using the well data, and a second coefficient of friction value;

adjusting the second coefficient of friction value to cause the predicted differential pressure to match the measured differential pressure;

providing the adjusted second coefficient of friction value to the fluid friction model to obtain an updated predicted value of differential pressure;

using the first coefficient of friction to determine wellbore friction using the torque and drag model;

using the updated predicted value of differential pressure to compute a zero value for differential pressure; and controlling one or more drilling parameters for drilling the well using at least one of the determined wellbore friction at the surface location or the zero value for differential pressure.

16. The non-transitory computer-readable medium of claim 15, wherein the operations are performed automatically by a computer system that is coupled to one or more control systems of a drilling rig drilling the well and wherein adjusting the first coefficient of friction input to the torque and drag model includes adjusting the first coefficient of friction by a predetermined amount.

17. The non-transitory computer-readable medium of claim 15, wherein the well data comprises a plurality of inclination, an azimuth, a drilling mud weight, and a geometry of the well.

18. The non-transitory computer-readable medium of claim 15, wherein measuring the hook load and the torque at the surface location further comprises measuring and recording the hook load and torque at a steady state condition during one or more operations comprising one or more of hoisting or lowering, with a bit off bottom with or without rotating a pipe and rotating the pipe while the bit is off bottom without moving a drawworks.

19. The non-transitory computer-readable medium of claim 18, wherein the operations further comprise detecting the steady state condition during drilling and, when the steady state condition is detected, capturing the steady state condition by at least one of one or more filters that monitor drilling operations for the steady state condition, a predetermined condition that is input by an operator, and an automated sequence programmed to capture data that can be used to calibrate the torque and drag model.

20. The non-transitory computer-readable medium of claim 15, wherein the predicted hook load or the predicted torque are determined to match the measured hook load or the predicted torque, respectively, when their values are within a predetermined range therefor.

* * * * *